US006924589B2

(12) United States Patent
Tagami et al.

(10) Patent No.: US 6,924,589 B2
(45) Date of Patent: Aug. 2, 2005

(54) COLOR PICTURE TUBE DEVICE HAVING IMPROVED HORIZONTAL CONVERGENCE

(75) Inventors: Etsuji Tagami, Takatsuki (JP); Hiroshi Sakurai, Takatsuki (JP); Kazuo Nakano, Mukou (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 261 days.

(21) Appl. No.: 10/273,625

(22) Filed: Oct. 18, 2002

(65) Prior Publication Data

US 2003/0080669 A1 May 1, 2003

(30) Foreign Application Priority Data

Oct. 23, 2001 (JP) ..... 2001-325693
Jun. 14, 2002 (JP) ..... 2002-174928

(51) Int. Cl.[7] ..... H01J 31/02; H01J 29/70
(52) U.S. Cl. ..... 313/412; 313/440; 313/442
(58) Field of Search ..... 313/412, 414, 313/431, 433, 442, 440; 315/368.27, 368.28; 335/210, 213, 214

(56) References Cited

U.S. PATENT DOCUMENTS 4,231,009 A * 10/1980 Barkow ..... 335/212
5,565,732 A 10/1996 Sluyterman et al.
RE35,548 E 7/1997 Sluyterman et al.

FOREIGN PATENT DOCUMENTS

JP 02-239545 9/1990
JP 2001-043815 2/2001

* cited by examiner

*Primary Examiner*—Vip Patel
*Assistant Examiner*—Anthony Perry

(57) ABSTRACT

A color picture tube device that can adjust convergence without causing increases in cost and in power consumption is provided. One pair of magnetic flux generation means for generating a static quadrupole magnetic field are positioned above and below an area where a plurality of electron beams pass through. The static quadrupole magnetic field has an effect of adjusting convergence in a horizontal direction. In this construction, a magnetic flux generated by one of the two magnetic flux generation means that is closer to the plurality of electron beams is reduced, in sync with deflection of the plurality of electron beams in a vertical direction.

25 Claims, 21 Drawing Sheets

Y
40
41
S
N
151
1512
1511
B
G
R
X
0
1521
1522
152
N
S
51
50

COLOR PICTURE TUBE DEVICE HAVING IMPROVED HORIZONTAL CONVERGENCE

This application is based on Japanese Patent Applications Nos. 2001-325693 and 2002-174928 with domestic priority claimed from the former application, the contents of which are hereby incorporated by reference.

BACKGROUND OF THE INVENTION

1. Field of the Invention

The present invention relates to a color picture tube device that deflects a plurality of electron beams which are emitted from an electron gun having a plurality of in-line cathodes, and displays a color image on a phosphor screen.

2. Related Art

In a color picture tube device having an in-line electron gun in which cathodes corresponding to the three colors of red (R), green (G), and blue (B) are horizontally aligned, three electron beams emitted from the electron gun need to come together at an appropriate position on a phosphor screen (this is called "convergence"). Self convergence and dynamic convergence are conventional techniques which are widely used for producing convergence. Also, various techniques have been proposed for correcting different kinds of misconvergence.

One method of correcting misconvergence is a dynamic convergence technique synchronous with horizontal deflection, which rectifies a horizontal deflection current and supplies it to a quadrupole coil provided on the electron gun side of a deflection yoke (e.g. Proceedings of the SID, vol. 31/3, 1990, p. 205, DEFLECTION YOKE FOR SUPER-FINE-PITCH 20-in. (19V) IN-LINE COLOR CRT (TRINITRON)). However, due to the need for rectifying a horizontal deflection current of high frequency, such a horizontal deflection-synchronizing dynamic convergence technique has the drawbacks of increases in manufacturing cost and in power consumption.

SUMMARY OF THE INVENTION

The present invention aims to provide a color picture tube device that can produce convergence without increases in cost and in power consumption.

The stated object can be achieved by a color picture tube device that deflects a plurality of electron beams and produces a color image on a phosphor screen, including: an electron gun which has a plurality of in-line cathodes and emits the plurality of electron beams; a deflection yoke which includes a horizontal deflection coil generating a horizontal deflection magnetic field, a vertical deflection coil generating a vertical deflection magnetic field, and a core; a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects; and an auxiliary magnetic field generation unit which generates an auxiliary magnetic field for canceling out at least a part of the horizontal component of the quadrupole magnetic field, according to vertical deflection of the plurality of electron beams by the vertical deflection magnetic field.

According to this construction, the quadrupole magnetic field is used to produce convergence. The quadrupole magnetic field can be generated by a coil to which a steady-state current is supplied, or by a magnet. This enables convergence to be produced with low cost and low power consumption. Here, depending on the vertical deflection of the plurality of electron beams, the effect of the horizontal component of the quadrupole magnetic field may not be able to be neglected. In such a case, the effect of the horizontal component is canceled out by the auxiliary magnetic field.

The stated object can also be achieved by a color picture tube device that deflects a plurality of electron beams and produces a color image on a phosphor screen, including: an electron gun which has a plurality of in-line cathodes and emits the plurality of electron beams; a deflection yoke which includes a horizontal deflection coil generating a horizontal deflection magnetic field, a vertical deflection coil generating a vertical deflection magnetic field, and a core; and a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects, wherein the quadrupole magnetic field generation unit weakens the horizontal component of the quadrupole magnetic field, according to vertical deflection of the plurality of electron beams by the vertical deflection magnetic field.

The stated object can also be achieved by a color picture tube device that deflects a plurality of electron beams and produces a color image on a phosphor screen, including: an electron gun which has a plurality of in-line cathodes and emits the plurality of electron beams; a deflection yoke which includes a horizontal deflection coil generating a horizontal deflection magnetic field, a vertical deflection coil generating a vertical deflection magnetic field, and a core; a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects; and a magnetizable member which changes the vertical deflection magnetic field to a compound magnetic field, the compound magnetic field being made up of (a) the vertical deflection magnetic field and (b) a virtual auxiliary magnetic field for canceling out at least a part of the horizontal component of the quadrupole magnetic field in synchronization with vertical deflection of the plurality of electron beams by the vertical deflection magnetic field.

The position, size, and the like of the magnetizable member for changing the vertical deflection magnetic field to the compound magnetic field made up of the vertical deflection magnetic field and the virtual auxiliary magnetic field can be optimized based on the magnetic flux density measured using a gauss meter or similar, or can be optimized through simulation.

BRIEF DESCRIPTION OF THE DRAWINGS

These and other objects, advantages and features of the invention will become apparent from the following description thereof taken in conjunction with the accompanying drawings which illustrate specific embodiments of the invention.

In the drawings.

DESCRIPTION OF THE PREFERRED EMBODIMENTS

The following describes embodiments of a color picture tube device of the present invention, with reference to drawings.

First Embodiment (Overall Construction of a Color Picture Tube Device)

Figure 1:
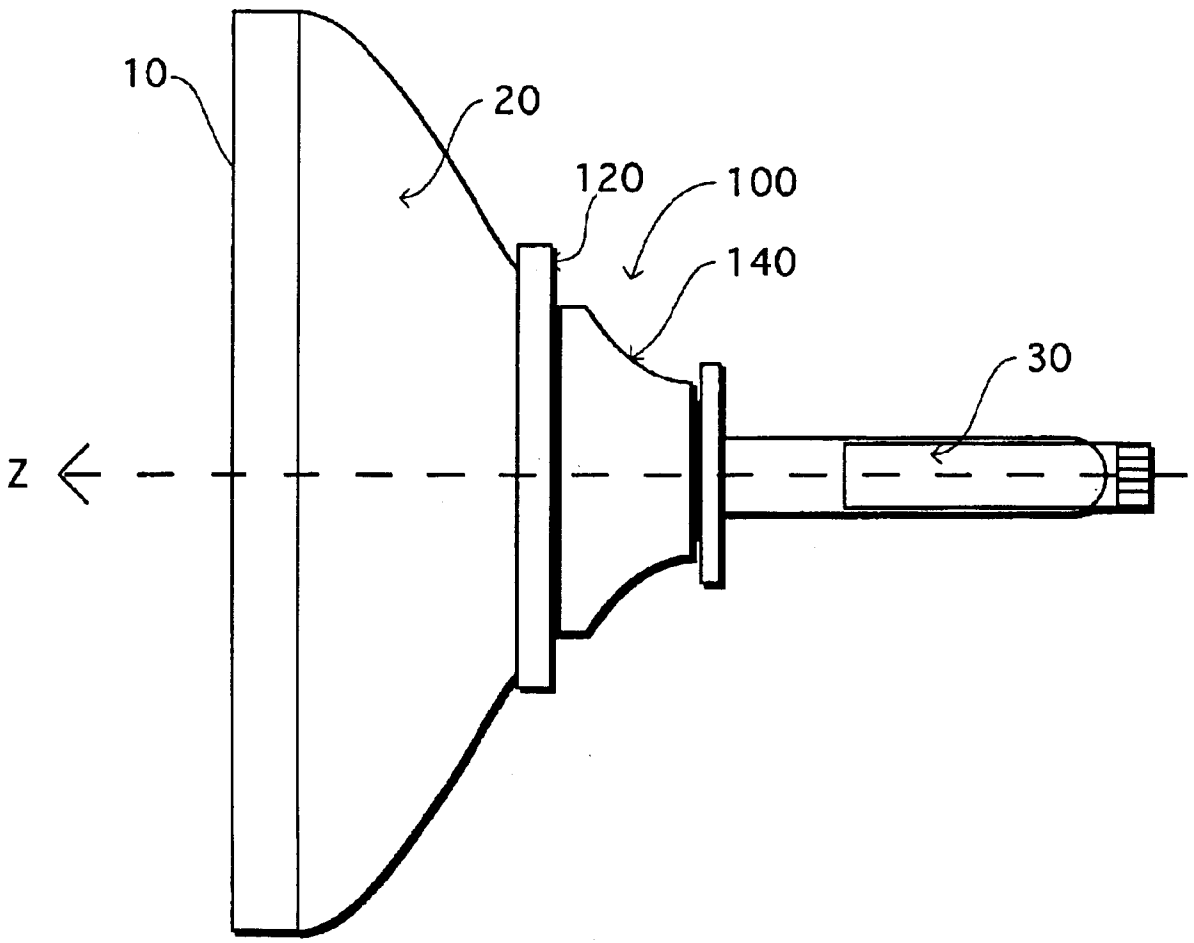
FIG. 1 is a side view of a color picture tube device to which embodiments of the invention relate.

FIG. 1 is a side view of a color picture tube device to which the embodiments of the present invention relate.

The color picture tube device is roughly made up of an envelope including a panel 10 and a funnel 20, an in-line electron gun 30, and a deflection yoke 100. A phosphor screen is formed on the internal face of the panel 10. The in-line electron gun 30 is provided in a neck of the funnel 20, and emits three electron beams toward the phosphor screen. The deflection yoke 100 is installed around the funnel 20. In the first embodiment, an electron gun that emits three horizontally-aligned electron beams in parallel with each other along the tube axis is used as the electron gun 30, so that the three electron beams are parallel with each other when entering a deflection region. The deflection region referred to here is a region where deflection magnetic fields generated by horizontal and vertical deflection coils in the deflection yoke 100 have deflection effects. Also, while the embodiment describes the case where the three electron beams are arranged in the order of B, G, and R from left to right as seen from the phosphor screen side, the invention is not limited to such an order.

Figure 2:
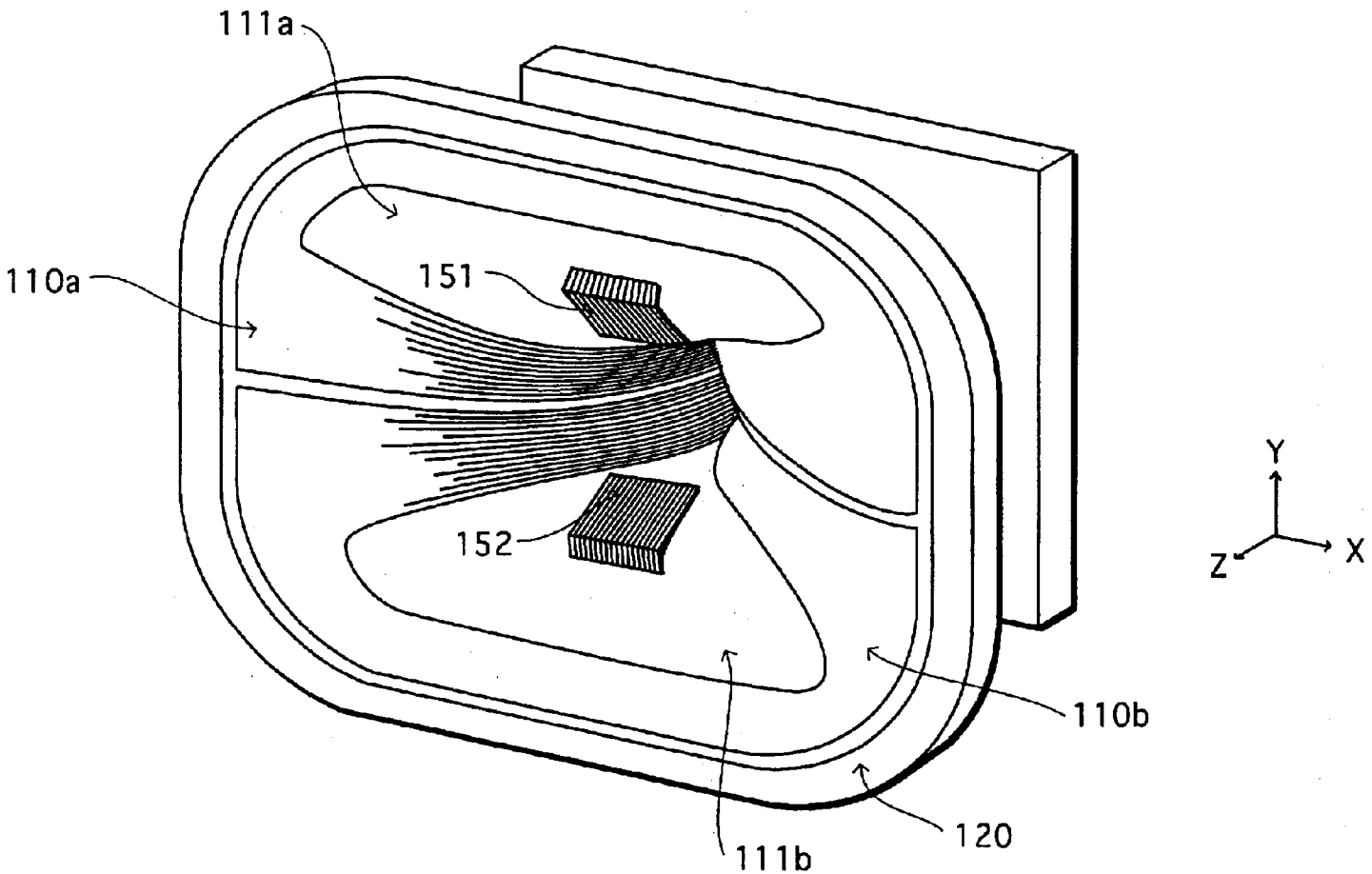
FIG. 2 is a perspective view showing an example construction of a deflection yoke.
Figure 3:
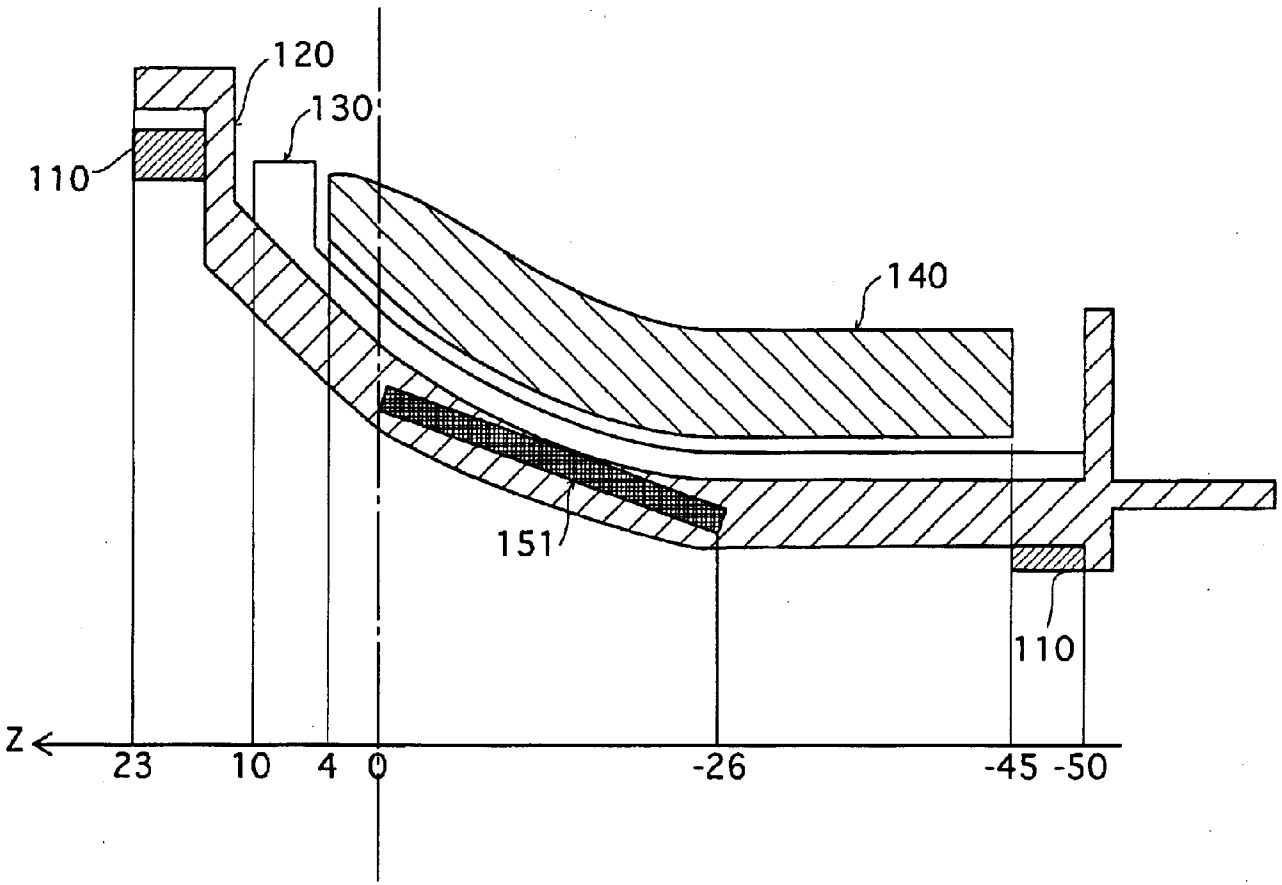
FIG. 3 is a cross section of the upper half of the deflection yoke, cut by a plane that is perpendicular to a horizontal direction (the direction of the X axis) and contains a tube axis.

The deflection yoke 100 forms deflection magnetic fields in the funnel 20, to deflect the electron beams emitted from the electron gun 30. FIG. 2 is a perspective view showing an example construction of the deflection yoke 100. FIG. 3 is a cross section of the upper half of the deflection yoke 100, cut by a plane that is perpendicular to a horizontal direction (the direction of the X axis) and contains the tube axis (the Z axis). The deflection yoke 100 includes a horizontal deflection coil 110, an insulating frame 120, a vertical deflection coil 130, and a ferrite core 140 which are provided in this order in an outward direction (from the inside of the funnel 20 toward the outside).

The horizontal deflection coil 110 is made up of one pair of horizontal coils 110*a* and 110*b* which are each formed by winding a wire in the shape of a saddle. The horizontal coils 110*a* and 110*b* are set so that their respective windows 111*a* and 111*b* provided in the middle face each other, and are positioned along the internal face of the insulating frame 120 so as to be in intimate contact with the insulating frame 120. Likewise, the vertical deflection coil 130 is made up of one pair of vertical coils which are each formed by winding a wire in the shape of a saddle. The ferrite core 140 is provided so as to surround these vertical coils. The ferrite core 140 serves as a magnetic core or the like, for each of the horizontal deflection coil 110 and the vertical deflection coil 130.

In this embodiment, two coils are provided in the windows 111*a* and 111*b*. In this specification, the coil provided in the window 111*a* is referred to as an upper coil 151, and the coil provided in the window 111*b* as a lower coil 152. The upper coil 151 and the lower coil 152 generate a quadrupole magnetic field through which the three electron beams pass. Hence the upper coil 151 and the lower coil 152 are hereafter collectively referred to as a quadrupole magnetic field generation coil. When passing through the quadrupole magnetic field generated by the quadrupole magnetic field generation coil, the three electron beams are acted upon by such a lens effect that brings the electron beams into convergence on the phosphor screen. This lens effect is explained in detail later.

The position of each member of the deflection yoke 100 is explained by referring to FIG. 3. In the drawing, the position of the phosphor screen end of the quadrupole magnetic field generation coil (the upper coil 151 in FIG. 3) is set as the origin point on the tube axis (the Z axis). Here, the origin point is coincided with the position of the deflection center which is called a reference line of the color picture tube device. Also, the phosphor screen side is set as the positive direction, while the electron gun side is set as the negative direction. This being so, the horizontal deflection coil 110 is located from Z=−50 to 23 mm, the vertical deflection coil 130 is located from Z=−50 to 10 mm, and the ferrite core 140 is located from Z=−45 to 4 mm. Meanwhile, the core piece of the upper coil 151 is located from Z=−26 to 0 mm. Though not illustrated, the position of the lower coil 152 in the direction of the tube axis is substantially the same as that of the upper coil 151. The core pieces of the upper coil 151 and lower coil 152 are made of a Ni ferrite, and have a width of 15 mm. These core pieces are embedded in the insulating frame 120 in the windows 111*a* and 111*b* respectively (though the upper coil 151 and the lower coil 152 are shown to appear in FIG. 2 for convenience in explanation). Note here that the upper coil 151 and the lower coil 152 do not necessarily need to be embedded in the insulating frame 120, so long as the upper coil 151 and the lower coil 152 are insulated from the horizontal deflection coil 110.

As shown in FIG. 3, it is preferable for the quadrupole magnetic field generation coil to be situated between the electron gun end of the ferrite core 140 and the phosphor screen in the direction of the tube axis. The reason for this is given below. A horizontal deflection magnetic field generated by the horizontal deflection coil 110 and a vertical deflection magnetic field generated by the vertical deflection coil 130 have their deflection effects substantially in a region which is closer to the phosphor screen than the electron gun end of the ferrite core 140. Therefore, if the quadrupole magnetic field is generated therebetween, the passing positions of the three electron beams in the quadrupole magnetic field change according to the deflection. This allows the three electron beams to be acted upon by an appropriate lens effect according to the deflection.

A horizontal sawtooth deflection current corresponding to a horizontal deflection frequency is supplied to the horizontal deflection coil 110. As a result, the horizontal deflection coil 110 generates a magnetic field in the vertical direction in the funnel 20, and deflects the electron beams in the horizontal direction. Meanwhile, a vertical sawtooth deflection current corresponding to a vertical deflection frequency is supplied to the vertical deflection coil 130. As a result, the vertical deflection coil 130 generates a magnetic field in the horizontal direction in the funnel 20, and deflects the electron beams in the vertical direction.

In this embodiment, the horizontal deflection magnetic field generated by the horizontal deflection coil 110 and the vertical deflection magnetic field generated by the vertical deflection coil 130 are each a substantially uniform magnetic field. A horizontal deflection magnetic field can be regarded as being substantially uniform when the following condition is met. The magnetic flux density of the vertical component of the horizontal deflection magnetic field does not vary with a displacement in the horizontal direction, and only varies with a displacement in the direction of the tube axis. Also, a vertical deflection magnetic field can be regarded as being substantially uniform when the following condition is met. The magnetic flux density of the horizontal component of the vertical deflection magnetic field does not vary with a displacement in the vertical direction, and only varies with a displacement in the direction of the tube axis.

The use of such substantially uniform magnetic fields as the deflection magnetic fields has the following advantage. Since the deflection magnetic fields which are substantially uniform have almost no distortions, the three electron beams are not acted upon by the lens effects of the deflection magnetic fields. Accordingly, the deformation of the electron beam spot shape does not occur. Hence a high resolution can be achieved.

Also, the three electron beams are parallel with each other when entering the electron gun end of the deflection region (i.e. the electron gun end of the ferrite core 140 in the deflection yoke 100) in this embodiment.

Thus, the deflection magnetic fields are substantially uniform, and the three electron beams entering the deflection region are parallel with each other. As a result, the three electron beams arriving at the phosphor screen have almost no mutual deviations in the vertical direction, though they have mutual deviations in the horizontal direction. Therefore, the three electron beams can be brought into convergence if the horizontal deviations are adjusted.

A construction of the quadrupole magnetic field generation coil is explained in detail below.

Figure 4:
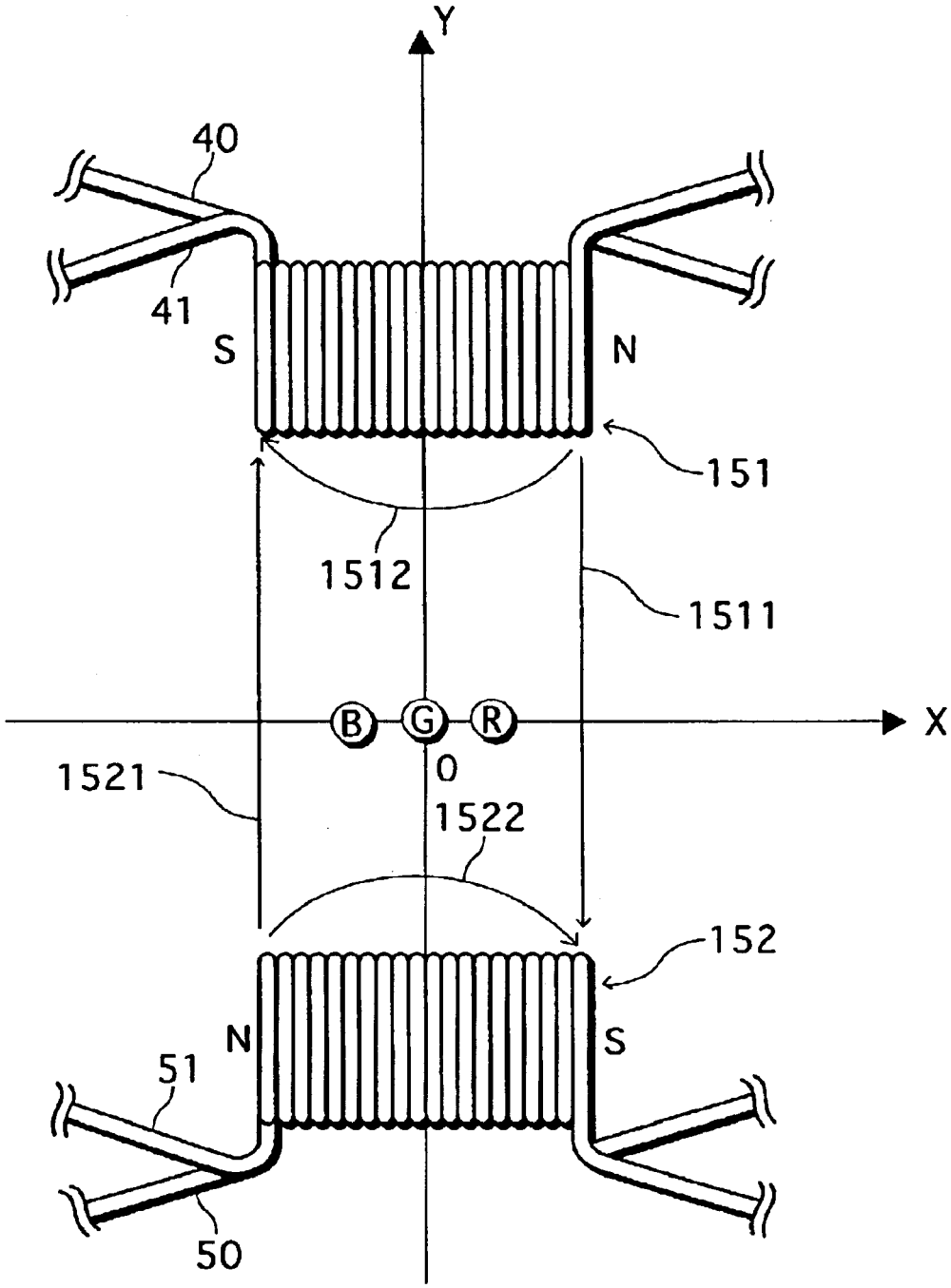
FIG. 4 illustrates a construction of a quadrupole magnetic field generation coil and an effect of a quadrupole magnetic field in the first embodiment.

FIG. 4 shows the upper coil 151, the lower coil 152, and the three electron beams (R, G, B) passing therebetween, as seen from the phosphor screen side. In this embodiment, the upper coil 151 and the lower coil 152 are each formed by winding two wires on a core piece. In the upper coil 151, a quadrupole magnetic field generation wire 40 and an auxiliary magnetic field generation wire 41 are wound together on a core piece. In the lower coil 152, a quadrupole magnetic field generation wire 50 and an auxiliary magnetic field generation wire 51 are wound together on a core piece. Each wire has the same number of turns, which is 100 in this embodiment. Also, the quadrupole magnetic field generation wires 40 and 50 are respectively insulated from the auxiliary magnetic field generation wires 41 and 51.

A steady-state current is supplied to the quadrupole magnetic field generation wires 40 and 50. Meanwhile, a current synchronous with the vertical deflection current is supplied to the auxiliary magnetic field generation wires 41 and 51.

Figure 5:
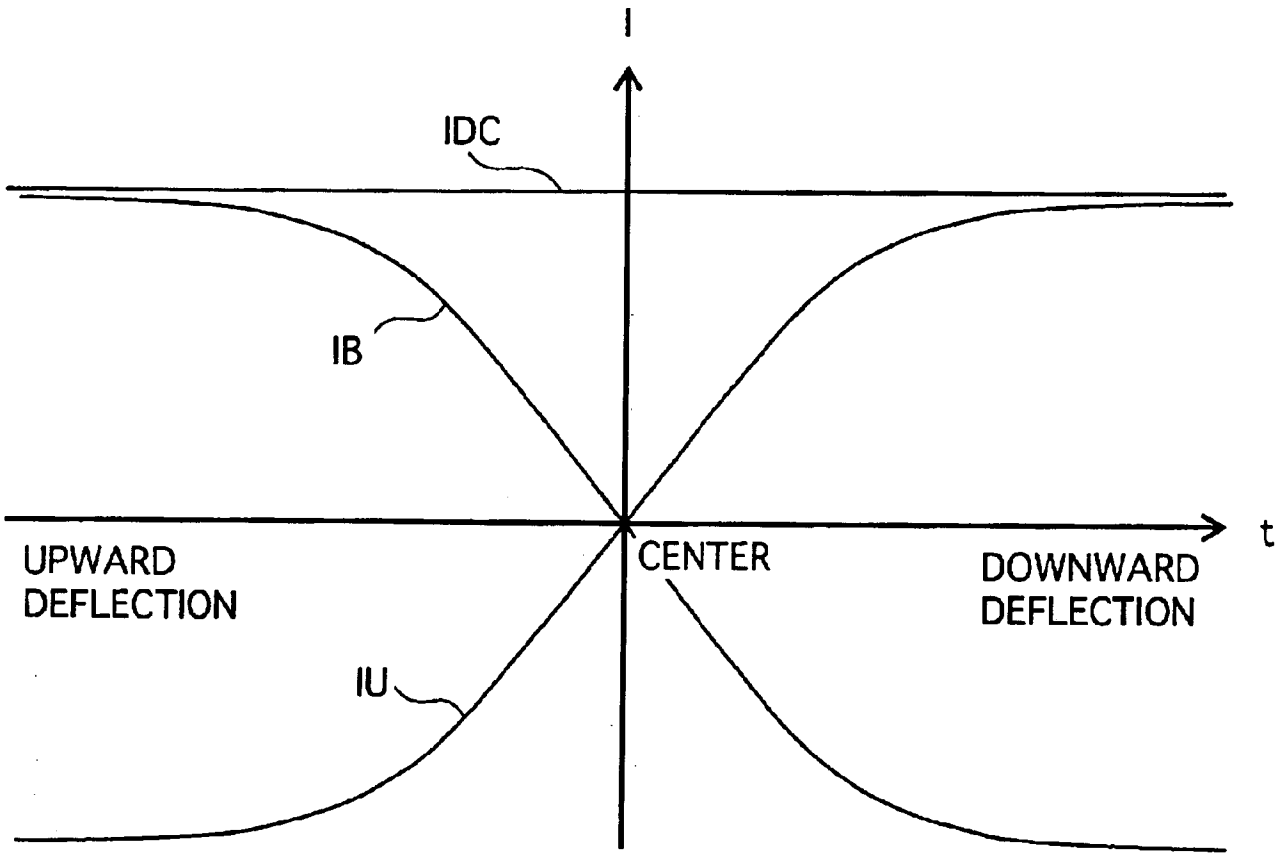
FIG. 5 shows the current-carrying states of wires in the quadrupole magnetic field generation coil shown in FIG. 4.

FIG. 5 shows the current-carrying states of these wires according to the vertical deflection. In the drawing, IDC denotes the current supplied to the quadrupole magnetic field generation wires 40 and 50 of the upper coil 151 and lower coil 152. IU denotes the current supplied to the auxiliary magnetic field generation wire 41 of the upper coil 151. IB denotes the current supplied to the auxiliary magnetic field generation wire 51 of the lower coil 152.

As can be seen from the drawing, a steady-state current is given to each of the wires 40 and 50. Here, the value of the steady-state current is positive. When the three electron beams are not vertically deflected, no current is supplied to the wires 41 and 51. When the three electron beams are deflected in an upward direction, a negative current is supplied to the wire 41 while a positive current is supplied to the wire 51, according to the deflection. The absolute values of these negative and positive currents increase with the upward deflection. When the amount of upward deflection is largest (corresponding to the left end of the drawing), the absolute values of the currents of the wires 41 and 51 are largest. When the three electron beams are deflected in a downward direction, a negative current is supplied to the wire 51 while a positive current is supplied to the wire 41, according to the deflection. The absolute values of these negative and positive currents increase with the downward deflection. When the amount of downward deflection is largest (corresponding to the right end of the drawing), the absolute values of the currents of the wires 41 and 51 are largest.

Since the vertical deflection frequency is low around several tens of Hz, supplying the currents synchronous with this vertical deflection frequency to the wires 41 and 51 can be done easily, without high power consumption or complex circuit construction.

The effect of such a constructed quadrupole magnetic field generation coil is explained below.

First, consider the case where the three electron beams are not vertically deflected.

When the three electron beams are not vertically deflected, no current flows through the wires 41 and 51. Therefore, the quadrupole magnetic field generation coil substantially acts as a magnet coil which is made up of only the core pieces and the wires 40 and 50, and so generates a quadrupole magnetic field. In this embodiment, the north pole of the upper coil 151 and the south pole of the lower coil 152 face each other on the right in the horizontal direction whereas the south pole of the upper coil 151 and the north pole of the lower coil 152 face each other on the left in the horizontal direction, as shown in FIG. 4. Accordingly, the quadrupole magnetic field has a vertical component 1511 directed from the north pole of the upper coil 151 to the south pole of the lower coil 152 and a vertical component 1521 directed from the north pole of the lower coil 152 to the south pole of the upper coil 151. These vertical components 1511 and 1521 exert a force on the electron beams in the horizontal direction.

Figure 6:
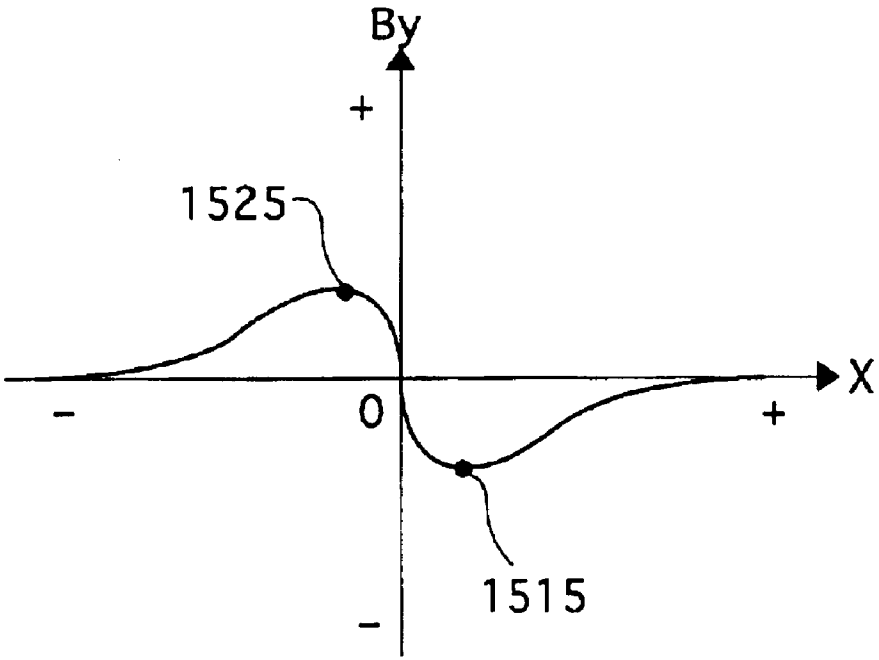
FIG. 6 shows an example of magnetic flux density distribution of the quadrupole magnetic field when no vertical deflection is performed.

The vertical components 1511 and 1521 of this quadrupole magnetic field have a magnetic flux density distribution in the horizontal direction shown in FIG. 6. Here, By denotes the magnetic flux density of the vertical components 1511 and 1521, and X denotes a displacement in the horizontal direction from the tube axis. Peaks 1515 and 1525 of the absolute value of the magnetic flux density occur near the magnetic poles, though they do not exactly coincide with the positions of the magnetic poles. The precise peak positions can be changed according to the factors such as the shape of each core piece of the quadrupole magnetic field generation coil (the shape of flowing out of the magnetic flux). The three electron beams always pass between these two peaks 1515 and 1525, irrespective of whether they are horizontally deflected or not. The passing positions of the three electron beams between the two peaks 1515 and 1525 differ according to the horizontal deflection.

Suppose the three electron beams are at the center of the quadrupole magnetic field, that is, they are deflected by neither the vertical deflection magnetic field nor the horizontal deflection magnetic field (i.e. when the central electron beam (G) is at the center as shown in FIG. 4). Then the central electron beam corresponds to X=0 in FIG. 6 and so is not affected by the quadrupole magnetic field. Meanwhile, the two outer electron beams (B and R) are acted upon by the vertical components of the quadrupole magnetic field that have opposite directions and similar intensities, so as to move toward the central electron beam. As a result of this horizontal converging effect, the three electron beams are brought into convergence. Such a horizontal converging effect is exerted by a magnetic lens formed by the quadrupole magnetic field.

Suppose the three electron beams are horizontally deflected. Since the quadrupole magnetic field is closer to the phosphor screen than the electron gun end of the deflection region, the passing positions of the three electron beams in the quadrupole magnetic field change according to the horizontal deflection. Hence the three electron beams are affected by the quadrupole magnetic field with different intensities. Here, the horizontal converging effect acting upon the three electron beams is weaker when compared with the case where the three electron beams are not horizontally deflected. In detail, the horizontal converging effect of the magnetic lens weakens from the center to the periphery in the horizontal direction. In other words, the magnetic lens has an intensity distribution such that the horizontal converging effect becomes weaker as the distance from the center increases in the horizontal direction. When the three electron beams are deflected more in the horizontal direction, they pass through a part of the magnetic lens where the horizontal converging effect is weaker. Thus, the three electron beams are subjected to a weaker horizontal converging effect in the periphery than in the center in the horizontal direction.

Figure 7:
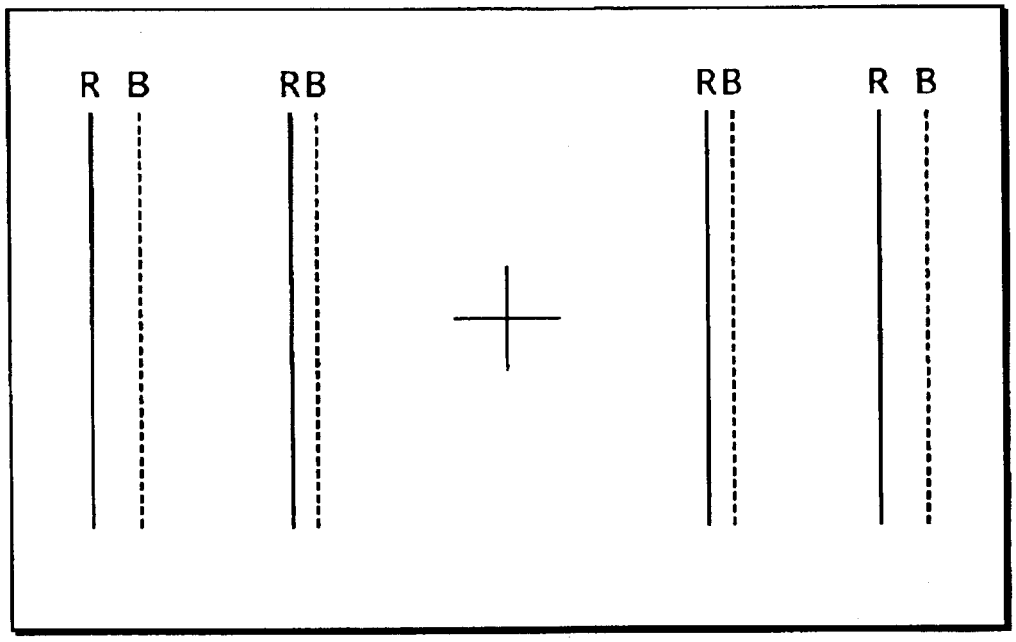
FIG. 7 shows a positive XH misconvergence pattern.

With this construction, the three electron beams can be converged at a farther point in the horizontal edges of the phosphor screen, when compared with the center of the phosphor screen. Accordingly, in a color picture tube device in which the distance between the electron gun and the phosphor screen is greater in the horizontal edges than in the center of the phosphor screen, proper convergence can be produced without causing horizontal deviations called "positive XH misconvergence" shown in FIG. 7. Also, since this is achieved by the intensity distribution of the magnetic lens, there is no need to vary the horizontal converging effect of the magnetic lens in sync with the horizontal deflection.

In this embodiment, when the magnetic field generated by the upper coil 151 and lower coil 152 is superposed on the horizontal deflection magnetic field, the vertical component of the resulting magnetic field has a magnetic flux density distribution that is asymmetrical in the horizontal direction with respect to the tube axis, as seen from above the tube axis. Such an asymmetrical magnetic flux density distribution delivers the aforementioned lens effect for adjusting convergence. This is a distinctive feature of the present invention, when compared with a conventional horizontal deflection magnetic field whose magnetic flux density distribution is symmetrical. In other words, the magnetic field for adjusting convergence in the present invention is not limited to a quadrupole magnetic field.

Next, consider the case where the three electron beams are vertically deflected.

The distance between the electron gun and the phosphor screen is greater in the vertical edges than in the center of the phosphor screen, as in the case of the horizontal direction. To produce proper convergence, therefore, the horizontal converging effect of the quadrupole magnetic field needs to be weakened according to the vertical deflection. However, simply weakening the whole quadrupole magnetic field according to the vertical deflection cannot achieve proper convergence. The reason for this is given below.

The quadrupole magnetic field shown in FIG. 4 has a horizontal component 1512 generated between the two magnetic poles of the upper coil 151 and a horizontal component 1522 generated between the two magnetic poles of the lower coil 152, in addition to the vertical components 1511 and 1521 between the upper coil 151 and the lower coil 152. When the three electron beams are vertically deflected, the electron beams become closer to either the upper coil 151 or the lower coil 152. As a result, the electron beams are affected by either the horizontal component 1512 or the horizontal component 1522. The horizontal component 1512 exerts a force of moving the electron beams upwardly, whilst the horizontal component 1522 exerts a force of moving the electron beams downwardly.

Figure 8:
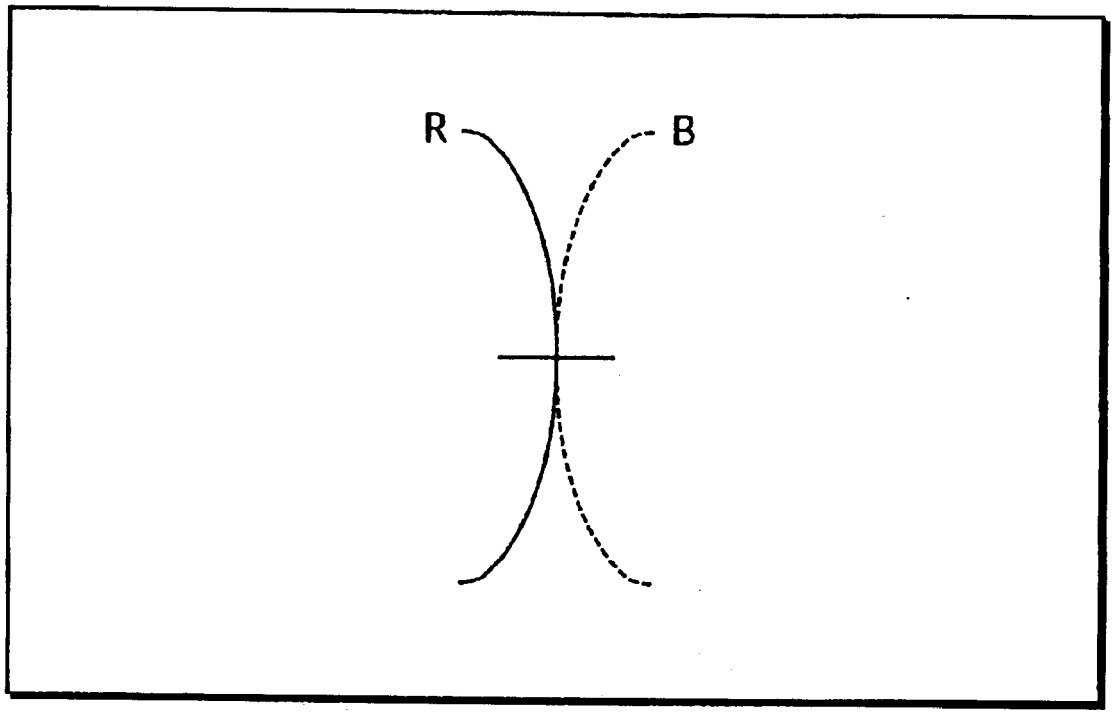
FIG. 8 shows a positive YH misconvergence pattern.
Figure 9:
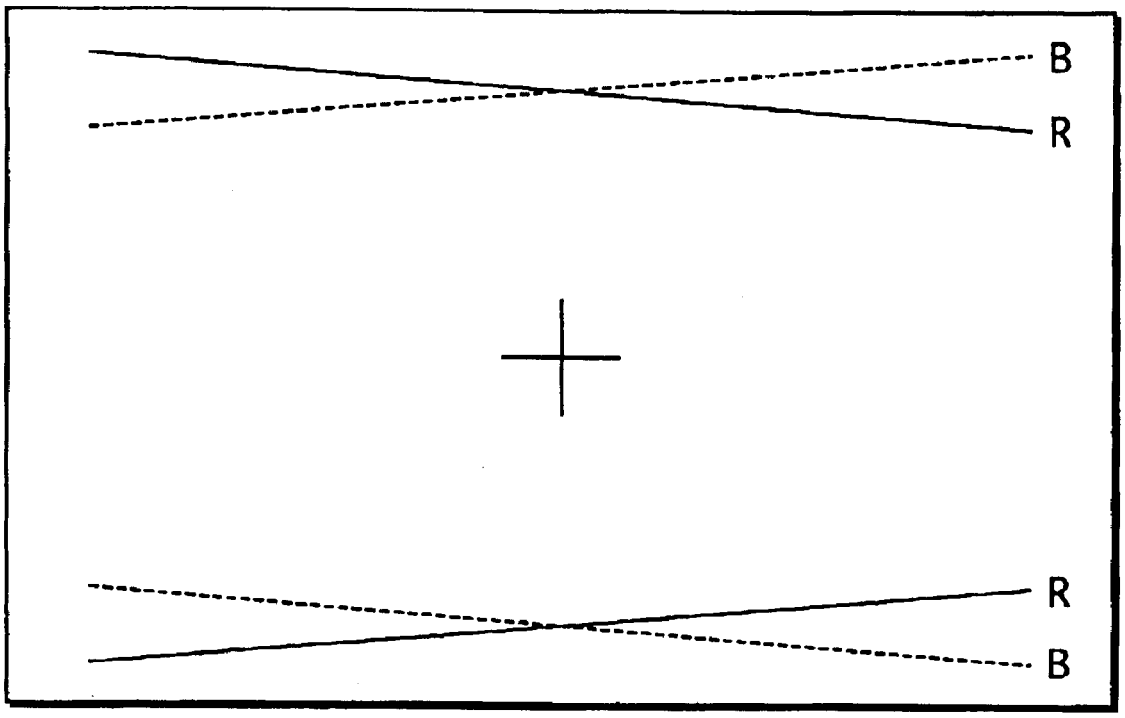
FIG. 9 shows a positive PQV misconvergence pattern.

Therefore, the three electron beams which are vertically deflected tend to be moved in different directions due to these horizontal components 1512 and 1522. Hence unwanted forces, such as an additional force of moving the three electron beams closer to each other in the horizontal direction and a force of deviating the three electron beams in the vertical direction, arise according to the vertical direction. This being so, the three electron beams may meet each other before they reach the phosphor screen (this is called "overconvergence"). This causes horizontal misconvergence called "positive YH misconvergence" to occur in the upper and lower portions of the phosphor screen as shown in FIG. 8, or vertical misconvergence called "positive PQV misconvergence" to occur in the corners of the phosphor screen as shown in FIG. 9.

Figure 10:
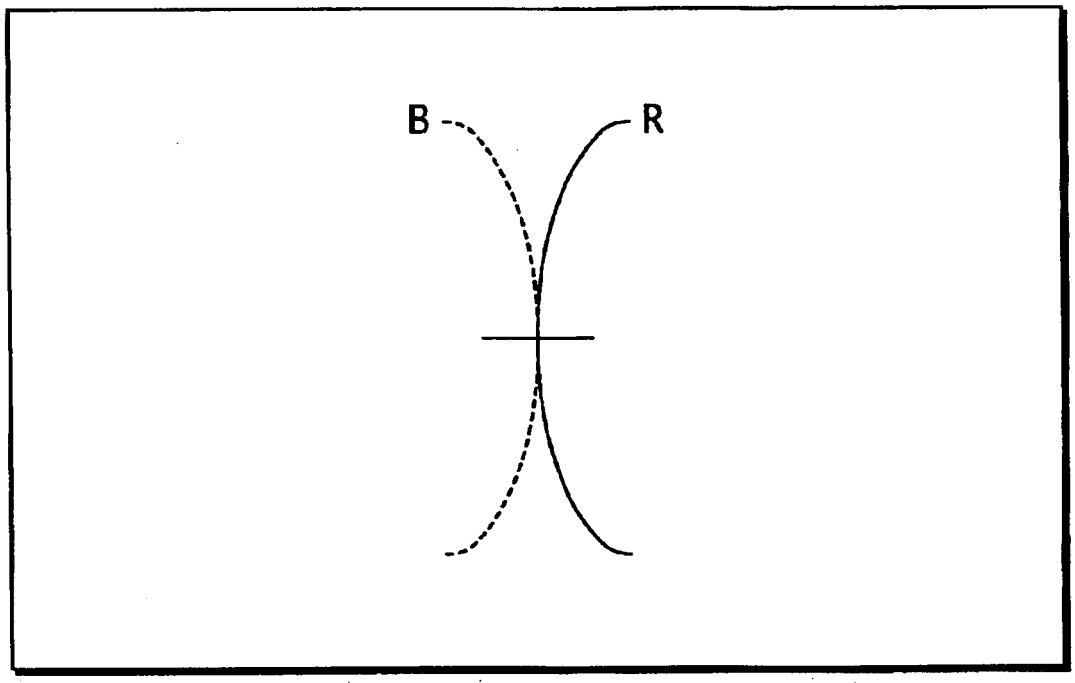
FIG. 10 shows a negative YH misconvergence pattern.

Even if the quadrupole magnetic field is weakened to a degree enough to suppress the positive YH misconvergence, the positive PQV misconvergence remains. On the other hand, when the quadrupole magnetic field is weakened to a degree enough to suppress the positive PQV misconvergence, the three electron beams will fall short of meeting each other when they reach the phosphor screen (this is called "underconvergence"). This causes horizontal misconvergence called "negative YH misconvergence" to occur in the upper and lower portions of the phosphor screen, as shown in FIG. 10. This is because simply weakening the whole quadrupole magnetic field according to the vertical deflection causes not only the horizontal components but also the vertical components to become weaker.

The present invention provides a technique for suppressing such misconvergence by actively weakening the horizontal components. To do so, the auxiliary magnetic field generation wires 41 and 51 are wound together with the quadrupole magnetic field generation wires 40 and 50 in the quadrupole magnetic field generation coil. This being so, the currents flowing through the auxiliary magnetic field generation wires 41 and 51 are controlled to weaken the horizontal components of the quadrupole magnetic field. This is explained in detail below.

In this embodiment, the upper coil 151 and the lower coil 152 include the auxiliary magnetic field generation wires 41 and 51 as well as the quadrupole magnetic field generation wires 40 and 50, as shown in FIG. 4. As noted earlier, a steady-state current is supplied to each of the quadrupole magnetic field generation wires 40 and 50, whereas a current synchronous with the vertical deflection current is supplied to each of the auxiliary magnetic field generation wires 41 and 51.

Figure 11:
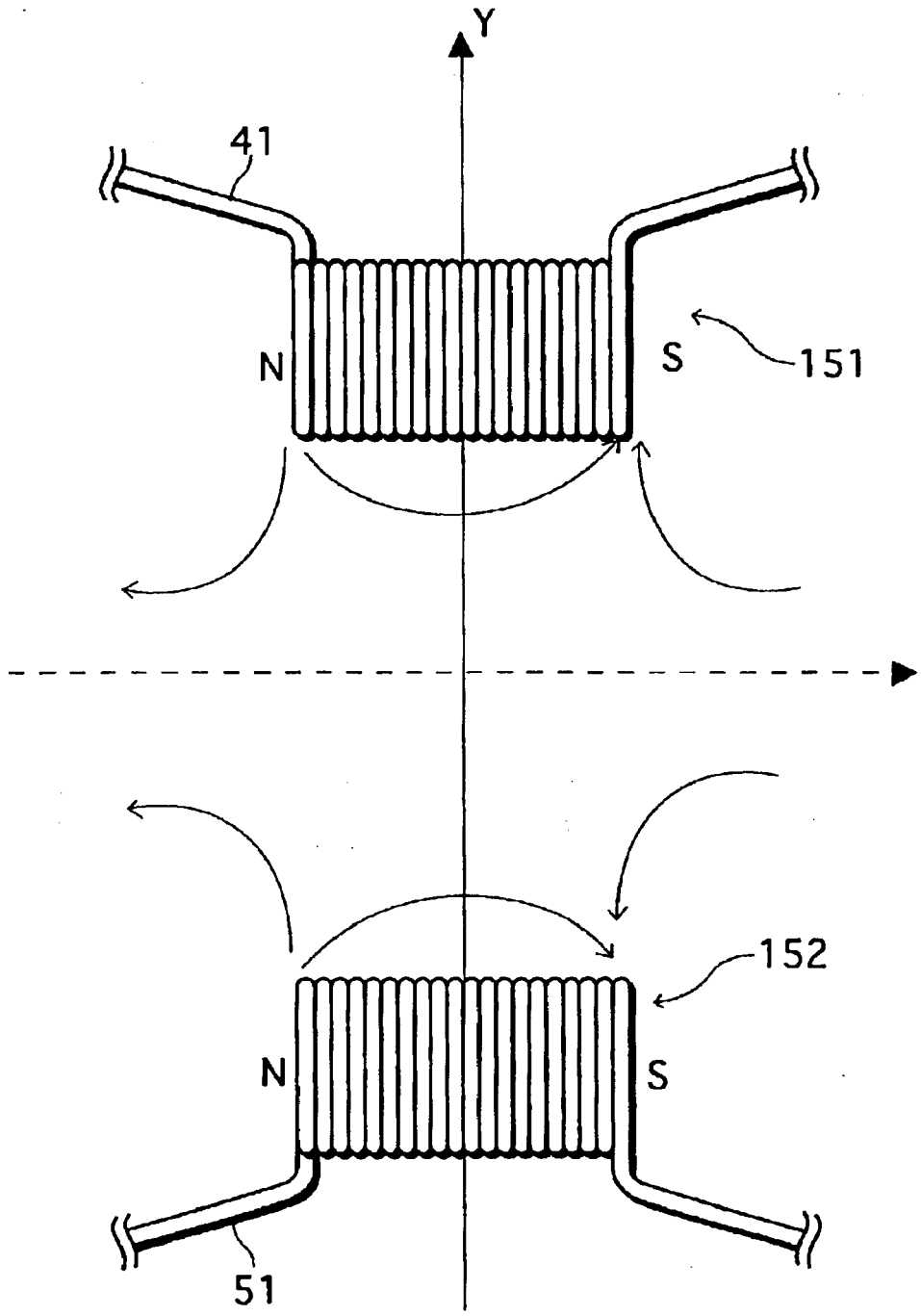
FIG. 11 is a representation of a dipole-sextupole compound auxiliary magnetic field.

For purposes of explanation, consider a magnetic field which is formed only from the core pieces and the wires 41 and 51, without taking the wires 40 and 50 into account. Suppose the three electron beams are upwardly deflected. When the currents shown in FIG. 5 are supplied to the wires 41 and 51, the south pole of the upper coil 151 and the south pole of the lower coil 152 face each other on the right in the horizontal direction whereas the north pole of the upper coil 151 and the north pole of the lower coil 152 face each other on the left in the horizontal direction, as shown in FIG. 11. As a result, a compound magnetic field made up of a virtual sextupole magnetic field designated by the solid arrow and a virtual dipole magnetic field designated by the dashed arrow is generated (such a compound magnetic field is hereafter referred to as a "dipole-sextupole compound auxiliary magnetic field").

When the three electron beams are upwardly deflected, this dipole-sextupole compound auxiliary magnetic field is superposed on the quadrupole magnetic field shown in FIG. 4. The currents are supplied to the wires 40, 41, 50, and 51 as shown in FIG. 5. Accordingly, when the three electron beams are upwardly deflected, the horizontal component 1512 shown in FIG. 4 is weakened according to the vertical deflection. Also, when the three electron beams are downwardly deflected, the horizontal component 1522 is weakened according to the vertical deflection. In the meantime, the vertical components 1511 and 1521 weaken according to the vertical deflection, too. However, the degree of weakness of the vertical components 1511 and 1521 is smaller than that of the horizontal components 1512 and 1522, partly because the amount of current supplied to the wire 51 of the lower coil 152 increases in the case of upward direction, as shown in FIG. 5.

Thus, even when the three electron beams are vertically deflected, they are not affected by the upward or downward effect of the horizontal component 1512 or 1522. Besides, the horizontal converging effect of the vertical components 1511 and 1521 is weakened to an appropriate degree. Hence neither the YH misconvergence nor the PQV misconvergence occurs, with it being possible to produce proper convergence.

This embodiment describes the case where a steady-state current is supplied to each of the wires 40 and 50. Here, fine adjustments may be made to the current supplied to each of the wires 40 and 50. Also, to reduce the horizontal components of the quadrupole magnetic field by superposing the auxiliary magnetic field on the quadrupole magnetic field as in this embodiment, magnets may be employed to generate a magnetic flux corresponding to the magnetic flux generated by the wires 40 and 50. In this case, it is unnecessary to supply the steady-state current IDC shown in FIG. 5. As an alternative, wires may be wound on these magnets to make fine adjustments. Also, this embodiment describes the case where separate wires are used as the wire 40 of the upper coil 151 and the wire 50 of the lower coil 152, but the same wire may be used if the same steady-state current is supplied.

Second Embodiment

The first embodiment describes how to produce convergence in a color picture tube device in which the deflection magnetic fields are substantially uniform and the three electron beams entering the deflection region are parallel with each other. In such a color picture tube device, the three electron beams will end up being underconverged in the center and edges of the phosphor screen if there is no quadrupole magnetic field. Hence the quadrupole magnetic field having the horizontal converging effect is employed to converge the three electron beams.

However, the applicable scope of the present invention is not limited to a color picture tube device in which the deflection magnetic fields are substantially uniform and the three electron beams are parallel with each other. The present invention is applicable even when the deflection magnetic fields have some distortions or when the three electron beams are not parallel with each other. In a color picture tube device that has non-parallel electron beams or distorted deflection magnetic fields, the three electron beams may be overconverged notably in the center of the phosphor screen if there is no quadrupole magnetic field. The following describes a technique for converging the three electron beams in such a case.

Figure 12:
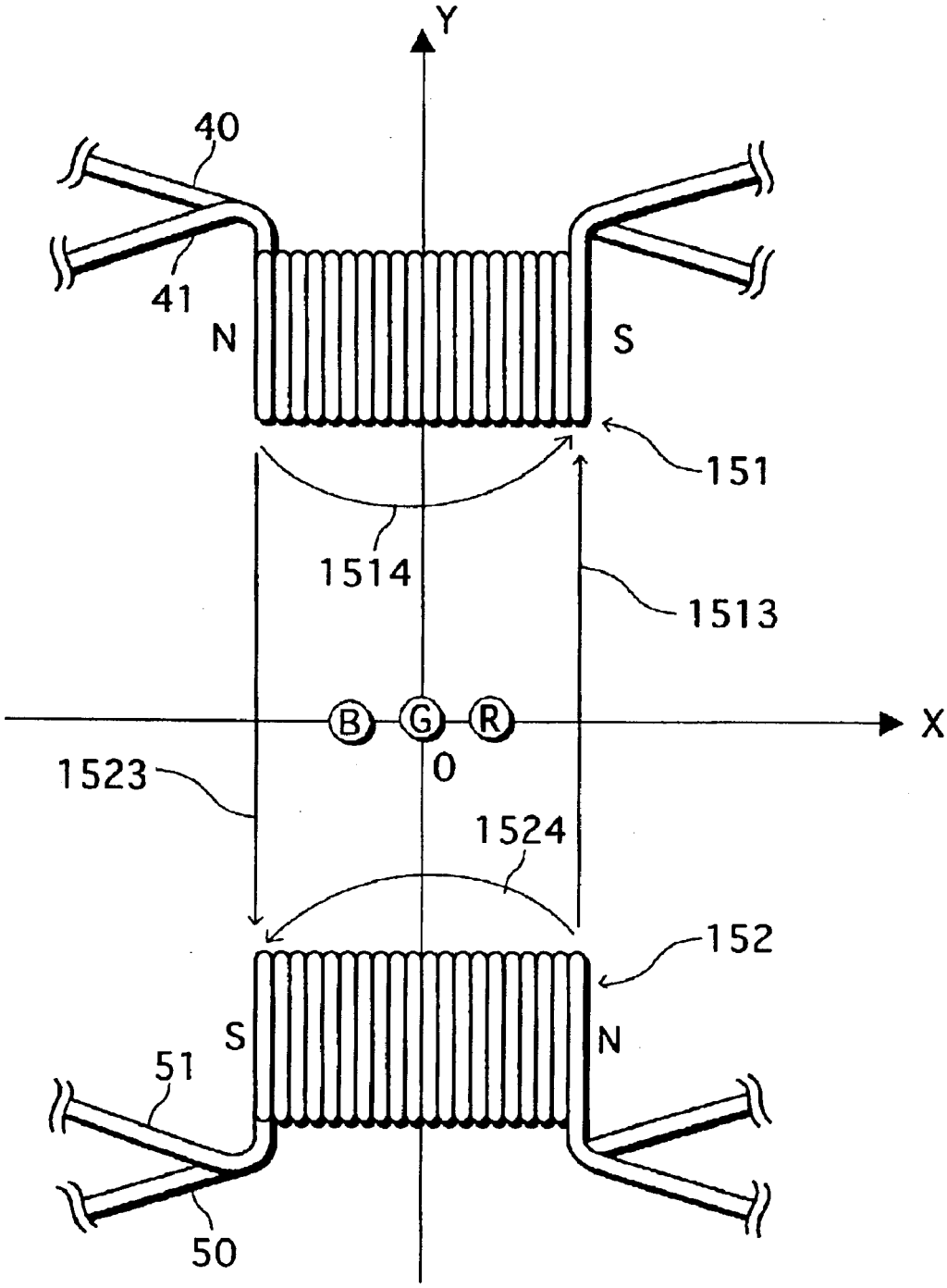
FIG. 12 illustrates a construction of a quadrupole magnetic field generation coil and an effect of a quadrupole magnetic field in the second embodiment.
Figure 13:
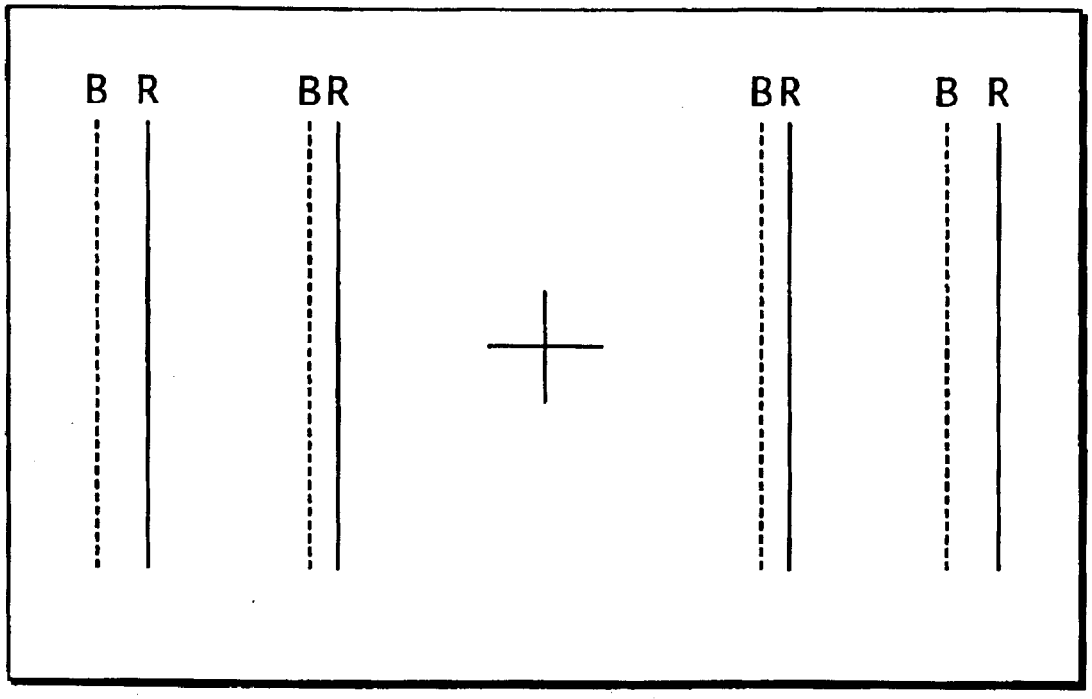
FIG. 13 shows a negative XH misconvergence pattern.

FIG. 12 shows a quadrupole magnetic field of the second embodiment. This drawing corresponds to FIG. 4 in the first embodiment. As illustrated, the north pole and the south pole of each of the upper coil 151 and the lower coil 152 have been interchanged from the first embodiment. This being so, vertical components 1513 and 1523 of this quadrupole magnetic field exert a horizontal diverging effect on the three electron beams. With this horizontal diverging effect, the aforementioned overconvergence in the center of the phosphor screen can be corrected. Also, this horizontal diverging effect weakens according to the horizontal deflection. Therefore, horizontal deviations called "negative XH misconvergence" (see FIG. 13), which occurs when the electron beams are acted upon by a diverging effect in the horizontal edges, can be prevented. Hence the three electron beams are brought into proper convergence according to the horizontal deflection.

Figure 14:
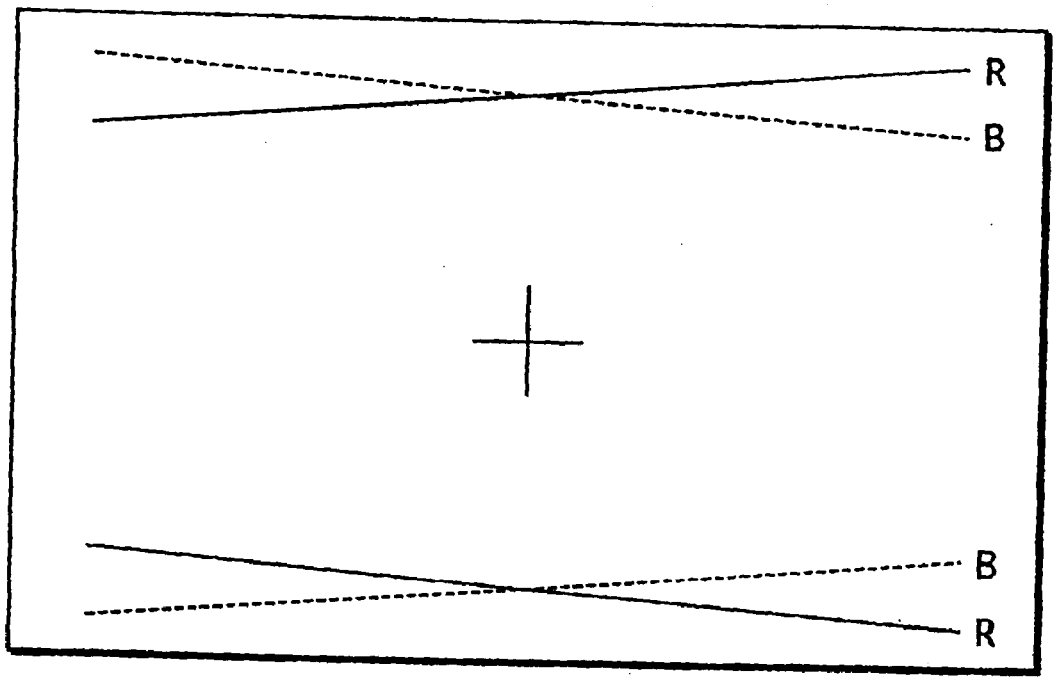
FIG. 14 shows a negative PQV misconvergence pattern.

In this embodiment, when the three electron beams are vertically deflected, they are affected by horizontal components 1514 and 1524 of the quadrupole magnetic field, as in the first embodiment. This may cause horizontal misconvergence called "negative YH misconvergence" shown in FIG. 10, or vertical misconvergence called "negative PQV misconvergence" shown in FIG. 14.

Even when the quadrupole magnetic field is weakened to a degree enough to suppress the negative YH misconvergence, the negative PQV misconvergence remains. On the other hand, when the quadrupole magnetic field is weakened to a degree enough to suppress the negative PQV misconvergence, the three electron beams meet each other before they reach the phosphor screen, which causes the positive YH misconvergence to occur in the upper and lower portions of the phosphor screen as shown in FIG. 8. Thus, it is difficult to produce convergence just by weakening the whole quadrupole magnetic field according to the vertical deflection.

In view of this, an auxiliary magnetic field is superposed on the quadrupole magnetic field so as to reduce the horizontal components of the quadrupole magnetic field according to the vertical deflection, like the first embodiment. In this way, the above misconvergence can be prevented. Since the orientation of the quadrupole magnetic field in this embodiment is opposite to that of the first embodiment, the orientation of the auxiliary magnetic field needs to be opposite, too. Also, adjustments need be made to the numbers of turns of the wires 41 and 51 and the like, in consideration of the differences of the deflection magnetic fields from the first embodiment. The method of reducing the horizontal components of the quadrupole magnetic field, including the current-carrying states of the wires shown in FIG. 5, is similar to that of the first embodiment so long as modifications are made to reverse the direction of the magnetic flux of the first embodiment. Therefore, its detailed explanation has been omitted here.

The first and second embodiments describe the case where a quadrupole magnetic field generation wire and an auxiliary magnetic field generation wire are wound on the same core piece, but the method of generating the auxiliary magnetic field is not limited to such. For instance, a saddle coil may be provided in the vicinity of the vertical deflection coil of the deflection yoke. Also, a troidal coil may be provided in the vicinity of the vertical deflection coil. When such a separate coil is used to generate the auxiliary magnetic field, it becomes unnecessary to double-wind the upper coil 151 and the lower coil 152. This allows the upper coil 151 and the lower coil 152 to be made smaller. Such upper coil 151 and lower coil 152 can be easily embedded in the insulating frame 120. Also, the aforementioned fine adjustments to the auxiliary magnetic field are facilitated. Furthermore, a troidal coil separate from the deflection coils may be used to generate the quadrupole magnetic field.

Third Embodiment

In the first and second embodiments, the auxiliary magnetic field generation wires 41 and 51 are respectively wound together with the quadrupole magnetic field generation wires 40 and 50 of the upper coil 151 and lower coil 152. The amount of current supplied to each of the auxiliary magnetic field generation wires is varied to cancel out the horizontal components of the quadrupole magnetic field in sync with the vertical deflection. In the third embodiment, the horizontal components of the quadrupole magnetic field are suppressed by varying the amount of current supplied to each of the quadrupole magnetic field generation wires themselves. This is explained in detail below.

Figure 15:
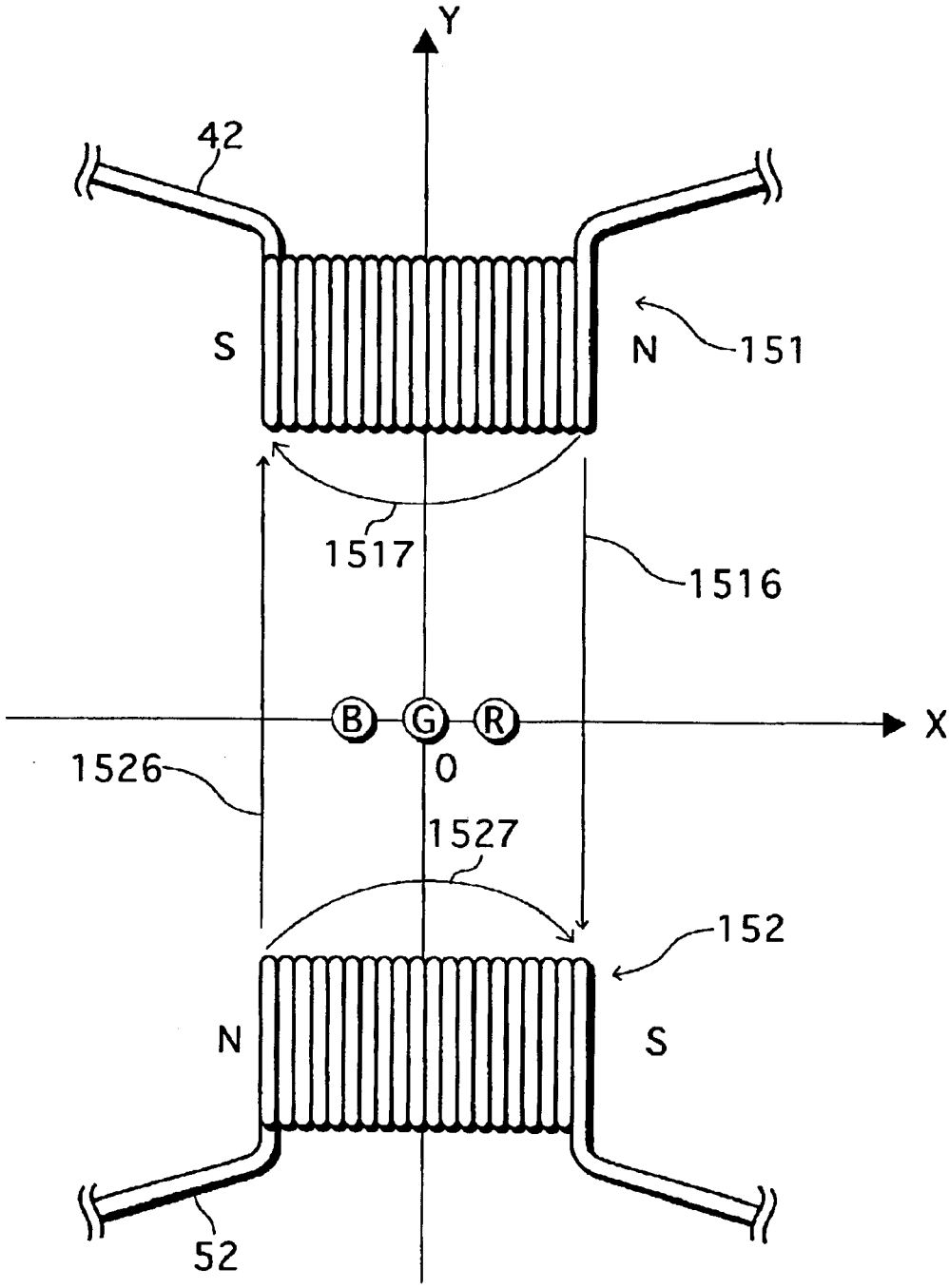
FIG. 15 illustrates a construction of a quadrupole magnetic field generation coil and an effect of a quadrupole magnetic field in the third embodiment.

FIG. 15 shows a construction of a quadrupole magnetic field generation coil and an effect of a quadrupole magnetic field in the third embodiment. In the drawing, the three electron beams passing between the upper coil 151 and the lower coil 152 are seen from the phosphor screen side. As illustrated, the upper coil 151 and the lower coil 152 have quadrupole magnetic field generation wires 42 and 52, and do not have auxiliary magnetic field generation wires.

Figure 16:
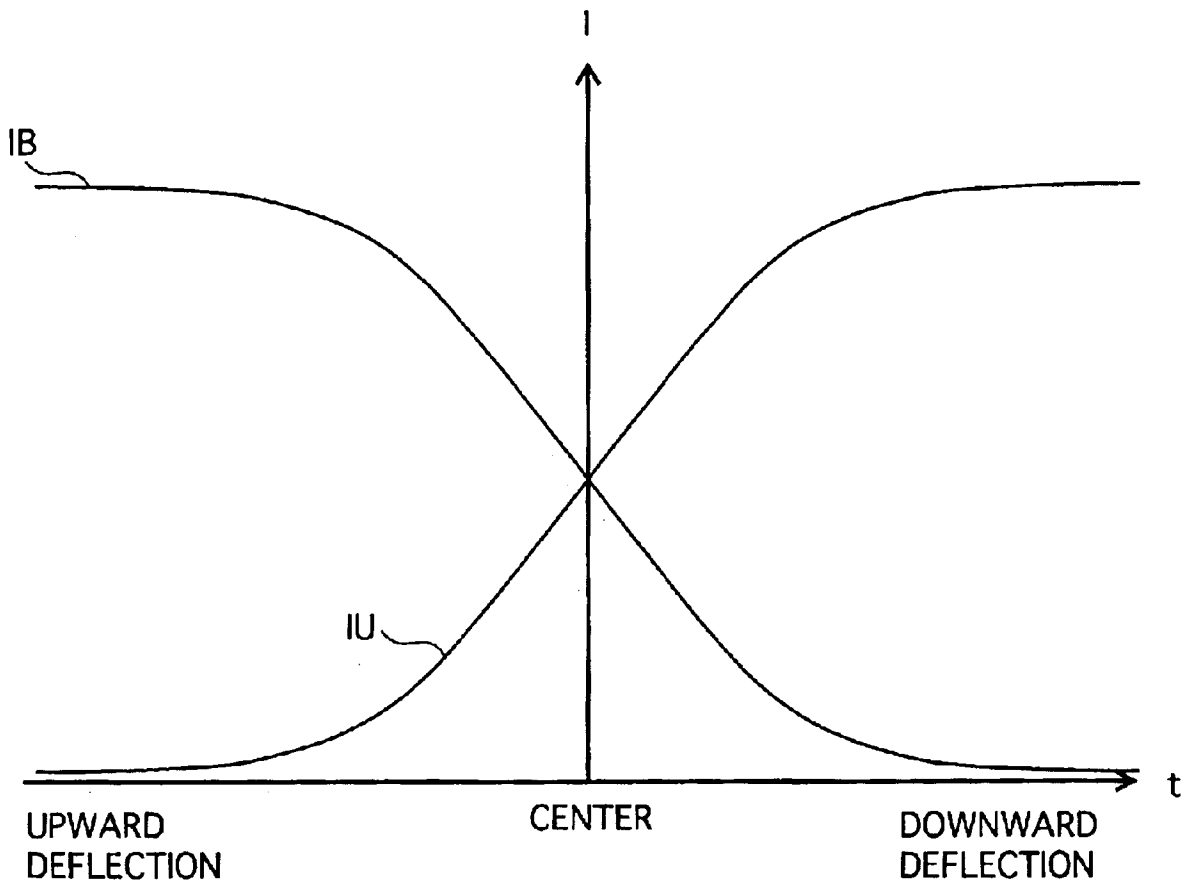
FIG. 16 shows the current-carrying states of wires in the quadrupole magnetic field generation coil in the third embodiment.

FIG. 16 shows the current-carrying states of the wire 42 of the upper coil 151 and the wire 52 of the lower coil 152.

In the drawing, the vertical axis shows coil current, whereas the horizontal axis shows vertical deflection. In more detail, the center of the horizontal axis corresponds to when the three electron beams are not vertically deflected. The left of the horizontal axis corresponds to when the three electron beams are upwardly deflected. The right of the horizontal axis corresponds to when the three electron beams are downwardly deflected. IU denotes the current supplied to the wire 42 of the upper coil 151, and IB denotes the current supplied to the wire 52 of the lower coil 152. As illustrated, the current supplied to the upper coil 151 decreases as the electron beams are more upwardly deflected, so as to weaken a horizontal component 1517 of the quadrupole magnetic field according to the vertical deflection. When the amount of upward deflection is largest, the horizontal component 1517 is smallest. On the other hand, the current supplied to the lower coil 152 decreases as the three electron beams are more downwardly deflected, so as to weaken a horizontal component 1527 of the quadrupole magnetic field according to the vertical deflection. When the amount of downward deflection is largest, the horizontal component 1527 is smallest. Conversely, the current supplied to the lower coil 152 increases when the three electron beams are more upwardly deflected, whilst the current supplied to the upper coil 151 increases when the three electron beams are more downwardly deflected. Accordingly, the degree of weakness of vertical components 1516 and 1526 of the quadrupole magnetic field according to the vertical deflection is smaller than that of the horizontal components 1517 and 1527.

In this way, even when the three electron beams are vertically deflected, they are not affected by the upward or downward effect of the horizontal component 1517 or 1527. Meanwhile, the horizontal converging effect by the vertical components 1516 and 1526 is weakened to an appropriate degree. Hence proper convergence can be achieved without causing YH misconvergence or PQV misconvergence, as in the first embodiment. It should be noted that the method of this embodiment can also be applied to the situation described in the second embodiment.

Modifications

The present invention has been described by way of the above embodiments, though it should be obvious that the invention is not limited to the above. Example modifications are given below.

(1) The above embodiments describe the case where the two coils are provided above and below the electron beams to generate the quadrupole magnetic field, but the invention is not limited to such. For example, two coils may be provided left and right of the electron beams, or four coils may be provided diagonally with respect to the electron beams. In any case, it is necessary to form such magnetic poles that generate a force of moving the three electron beams toward or away from each other in the horizontal direction.

Figure 17:
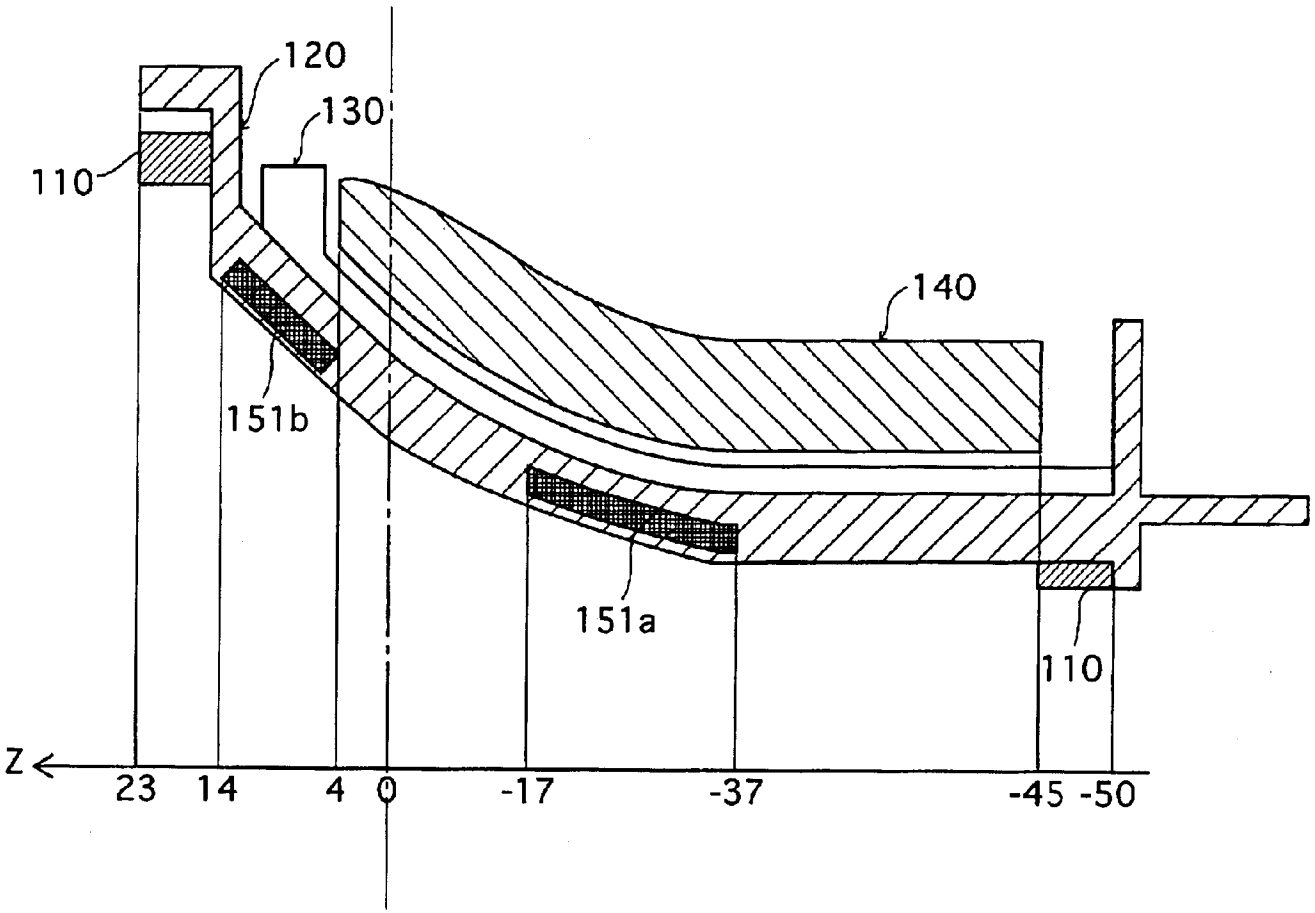
FIG. 17 is a representation of when an upper coil is divided so as to be situated in a plurality of positions in the direction of the tube axis.

(2) Each of the upper coil 151 and the lower coil 152 for generating the quadrupole magnetic field or the auxiliary magnetic field may be divided so as to be situated in a plurality of positions in the direction of the tube axis, as shown in FIG. 17. In the drawing, the upper coil 151 is divided into first magnetic flux generation means 151*a* on the electron gun side and second magnetic flux generation means 151*b* on the phosphor screen side. The first magnetic flux generation means 151*a* is positioned from Z=−37 to −17 mm, whereas the second magnetic flux generation means 151*b* is positioned from Z=14 to 4 mm. Here, a magnet with a width of 40 mm in the horizontal direction is used as the second magnetic flux generation means 151*b*. The same applies to the lower coil 152.

Such dividing the magnetic flux generation means for generating the quadrupole magnetic field and the like has the following advantage. The magnetic flux generation means on the phosphor screen side, i.e., the second magnetic flux generation means 151*b* shown in FIG. 17, has not only an effect of correcting XH misconvergence described above, but also an effect of correcting the so-called upper and lower pincushion distortions (described by EIAJ ED-2139 (4.3)).

(3) The above embodiments describe the case where the upper coil 151 and the lower coil 152 are embedded in the insulating frame 120. However, especially when magnets are used to generate the quadrupole magnetic field, the position of the quadrupole magnetic field and the magnetic flux density distribution, which require high precision, may not be able to be properly realized due to performance variations of these magnets.

To overcome this, a mechanism for making fine adjustments to the positions of the upper coil 151 and lower coil 152 (including the case where magnets are used) may be provided. FIG. 18 shows an example of such a fine adjustment mechanism. This drawing concerns only the upper coil 151, but the same applies to the lower coil 152.

Figure 18A:
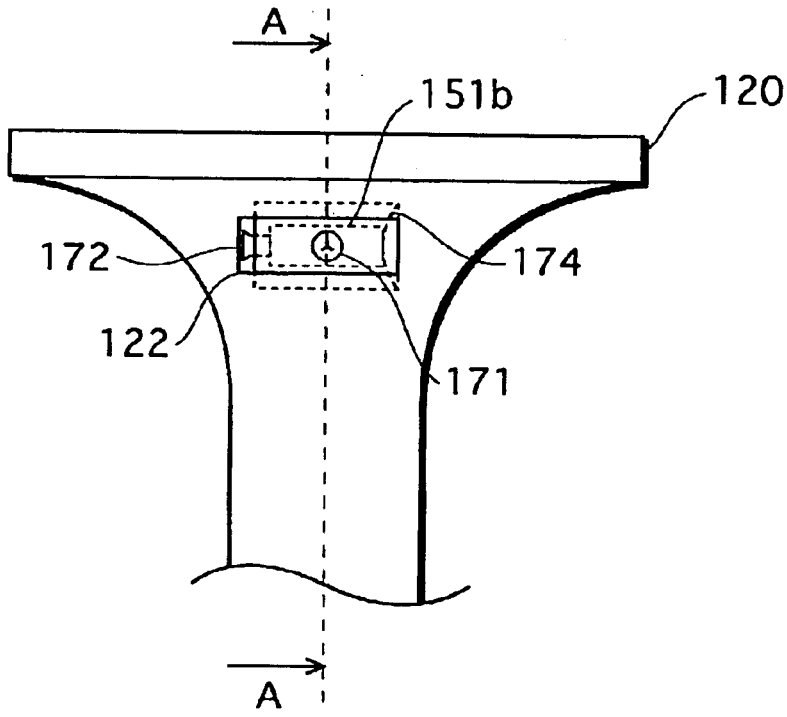
FIGS. 18A and 18B show an example construction of a fine adjustment mechanism for adjusting the position of the upper coil.
Figure 18B:
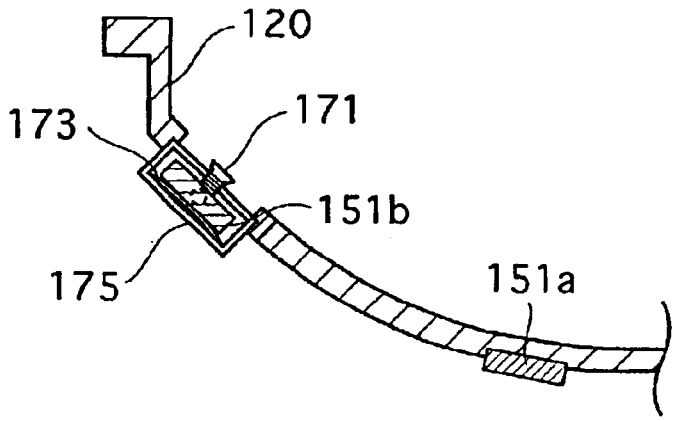

FIG. 18A is a schematic representation of when the insulating frame 120 is seen from above (the ferrite core 140 is not illustrated). FIG. 18B is a fragmentary cross section of this insulating frame 120 taken along the line A—A in FIG. 18A. The present example concerns the case where the upper coil 151 has been divided into the two parts in the direction of the tube axis as shown in FIG. 17 and fine adjustments are to be made to the coil 151*b* on the phosphor screen side. Note that the same mechanism can also be provided for the coil 151*a* on the electron gun side.

In FIG. 18, the coil 151*b* is housed in an enclosure 175 made of a resin or the like, and the enclosure 175 is fixed to the insulating frame 120 having a window 122. Flat springs 173 and 174 are provided in the enclosure 175. These flat springs 173 and 174 act as elastic bodies against the pressures of screws 171 and 172 upon the coil 151*b*. As one example, the positioning of the coil 151*b* can be performed using the screws 171 and 172, before the ferrite core 140 is mounted during the manufacture of the color picture tube device. Though not illustrated, the coil 151*b* may be covered with an insulating cover made of a plastic or the like, so that the wire 40 and the like will not be affected. Also, the wire 40 and the like may be wound while avoiding the screws 171 and 172.

By the provision of this mechanism, fine adjustments can be made to the position of the coil 151*b* in the vertical and horizontal directions. Through such adjustments, the magnetic flux density distribution of the quadrupole magnetic field in the vertical and horizontal directions can be adjusted, too. Although not shown in the drawings, the positioning of the upper coil 151 in the direction of the tube axis can be made easily using the same method. While the screws 171 and 172 and the flat springs 173 and 174 are used for positioning in the above example, the positioning means is not limited to such. For instance, flat members formed from an elastic material such as rubber may be used instead of the flat springs.

Also, the performance variations of the magnets may be addressed by making fine adjustments to the amount of current supplied to the wire 40 and the like. For example, a variable resistor may be provided in parallel with the winding part of the upper coil 151, to make fine adjustments to the current supplied to the upper coil 151.

(4) As mentioned earlier, magnets may be used as the core pieces of the upper coil 151 and lower coil 152 to generate the quadrupole magnetic field (it is actually preferable to use magnets for generating the quadrupole magnetic field in terms of power consumption). However, the inventors of the present invention found that a magnet coil in which an auxiliary magnetic field generation wire and the like are wound on the center of a mere magnet does not show favorable efficiency.

Figure 19A:
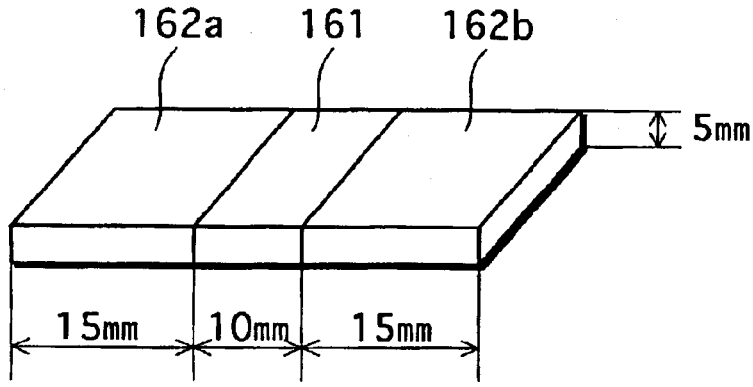
FIG. 19A shows a structure in which a magnetizable portion is connected to both ends of a magnet portion.

In view of this, the inventors of the present invention conducted a study and reached a conclusion that a structure made up of a magnet portion and a magnetizable portion exemplified in FIG. 19A is preferably used as the core piece of the upper coil 151 and the like. The structure shown in the drawing has a strong neodymium magnet 161 and magnetic cores 162*a* and 162*b*. The magnetic cores 162*a* and 162*b* are formed from a ferrite, and are connected to both ends of the magnet 161.

In the drawing, the magnet 161 has a horizontal width of 10 mm, while the magnetic cores 162*a* and 162*b* have a horizontal width of 15 mm. The magnet 161 and the magnetic cores 162*a* and 162*b* have a height of 5 mm. Though the length in the direction of the tube axis (the Z axis) is not shown in the drawing, the structure needs to be formed so that its position when embedded in the insulating frame 120 approximately matches that shown in FIG. 3 or FIG. 17.

Since the magnetic cores 162*a* and 162*b* serve as the core piece of the auxiliary magnetic field generation wire 41 and the like, the efficiency of the wound coil improves when compared with the case where the wire is wound on a mere magnet. Note here that the sizes of the structure members are not limited to the above example and can be optimized based on the factors such as the magnetic force of the magnet 161. If the size of the magnet 161 is minimized in a range where a necessary strength is ensured while the volume of the magnetic core 162*a* and the like is increased, the volume of the magnetic core 162*a* which is present inside the wire 41 increases. This improves the efficiency of generating the auxiliary magnetic field. Furthermore, the type of the magnet 161 is not specifically limited. In the example of FIG. 19A, a strong neodymium magnet is used because it is preferable to form the magnet 161 as small as possible.

Figure 19B:
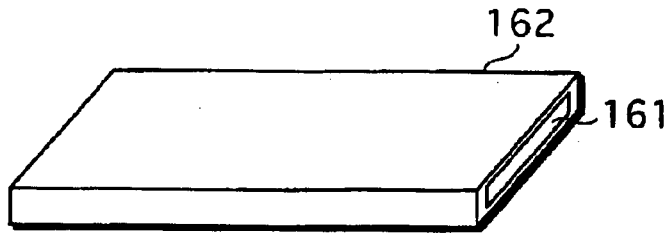
FIG. 19B shows a structure in which a magnet portion is covered with a magnetizable portion.

Furthermore, the entire structure may be covered with a magnetizable material, to suppress the influence of a leakage flux that arises from the joint between the magnet 161 and the magnetic core 162*a* or the like. Also, considering that it is preferable to provide a magnetizable portion inside the wire 41, a structure that is made up of the magnet 161 and a magnetic core 162 covering the magnet 161 may be used, as shown in FIG. 19B.

(5) In FIGS. 3 and 17, the core piece of the upper coil 151 and the like has a flat shape. In an actual color picture tube device, however, the glass bulb and especially the funnel have a curved surface that becomes wider toward the phosphor screen. Accordingly, if the core piece is flat, the middle part of the core piece in the direction of the tube axis is situated away from the funnel, though both ends of the core piece are situated close to the funnel. This causes decreases in efficiency of the quadrupole magnetic field and the auxiliary magnetic field.

Figure 19C:
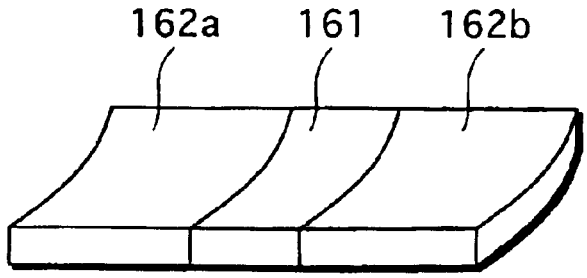
FIG. 19C shows an example where a core piece or a structure is curved along the shape of a glass bulb.

Therefore, the core piece or the above structure that is used in the upper coil 151 and the like is preferably shaped along the shape of the funnel. An example of this is shown in FIG. 19C. Though FIG. 19C concerns the case of using the magnet 161 shown in FIG. 19A, the same applies to the case where no magnet is used. Thus, by curving the core piece or the structure along the shape of the funnel, the quadrupole magnetic field and the auxiliary magnetic field can be used more efficiently. In FIG. 19C, the curvature is made in the direction of the tube axis. However, the core piece or the structure may also be curved in the horizontal direction. Thus, the specific shape of the core piece or structure can be freely designed in accordance with the shape of the glass bulb.

(6) In the above embodiments, even when the amount of upward deflection or downward deflection is largest, the absolute value of the current of the wire 41 or 51 is not equal to the absolute value of the current IDC (see FIG. 5), or the current of the wire 42 or 52 is not 0 (see FIG. 16). However, proper performance can still be obtained even when the absolute value of the current of the wire 41 or 51 is equal to the absolute value of the current IDC or when the current of the wire 42 or 52 is 0.

(7) The above embodiments describe the case where the quadrupole magnetic field and the auxiliary magnetic field for canceling out the horizontal components of the quadrupole magnetic field are generated in substantially the same position in the direction of the tube axis. However, this is not a limit for the present invention. For example, the quadrupole magnetic field and the auxiliary magnetic field may be generated in different positions in the direction of the tube axis. Also, the means for generating the auxiliary magnetic field and the means for generating the quadrupole magnetic field may be provided in different positions in the vertical direction.

(8) In the first and second embodiments, the auxiliary magnetic field is generated using the magnet coil to cancel out the horizontal components of the quadrupole magnetic field in sync with the vertical deflection.

However, the inventors of the present invention found that the same effects can also be achieved by providing a magnetizable member in the vertical deflection magnetic field. This is explained using a specific example below.

Figure 20A:
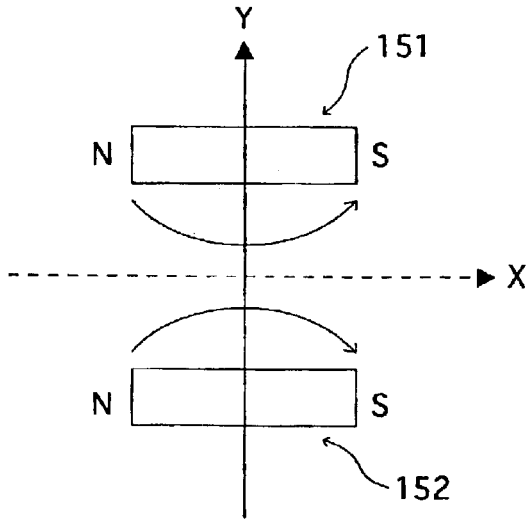
FIGS. 20A to 20C are diagrams for explaining effects of providing a magnetizable member in a vertical deflection magnetic field.
Figure 20B:
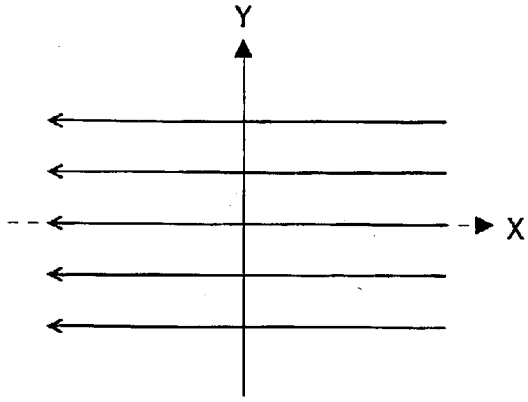
Figure 20C:
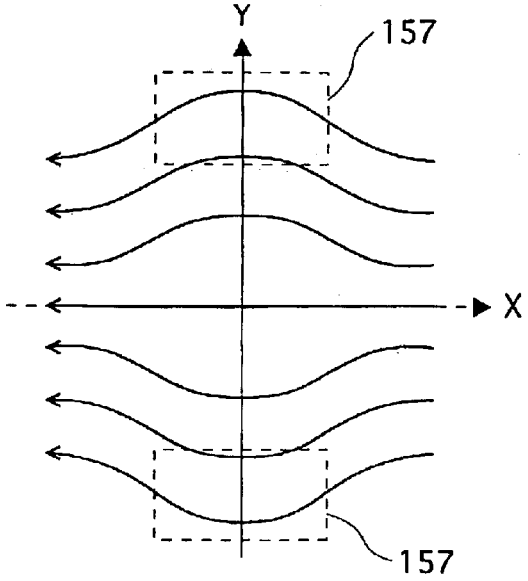

FIG. 20A is a diagrammatic sketch of the auxiliary magnetic field of the first embodiment (see FIG. 11). FIG. 20B is a diagrammatic sketch of a substantially uniform magnetic field as one example of the vertical deflection magnetic field (in the case of upward deflection). A compound magnetic field made up of these two magnetic fields is like the one shown in FIG. 20C. Accordingly, the effects of the present invention can be obtained if the vertical deflection magnetic field is changed to the magnetic field shown in FIG. 20C.

In view of this, the inventors of the present invention reached the following understanding. By providing a magnetizable member in a position which differs in the direction of the tube axis from a magnet coil (or a magnet) for generating the quadrupole magnetic field (see the dashed lines of FIG. 20C), the vertical deflection magnetic field can be changed into the compound magnetic field shown in FIG. 20C. Here, a magnetizable member 157 may be made of a permalloy or the like. Such a magnetizable member absorbs magnetic lines of force of the vertical deflection magnetic field. Accordingly, the magnetizable member reduces the magnetic flux density near the passing positions of the electron beams, when the electron beams are vertically deflected. This is equivalent to that the vertical deflection magnetic field is changed to the compound magnetic field of FIG. 20C made up of the vertical deflection magnetic field and the auxiliary magnetic field.

Here, it is more desirable to optimize the factors such as the material, position, and size of the magnetizable member, in order to achieve substantially the same effects as the auxiliary magnetic field. This optimization can be made based on the magnetic flux density measured using a gauss meter, or through simulation. A specific example of using such a magnetizable member is given below.

Figure 21:
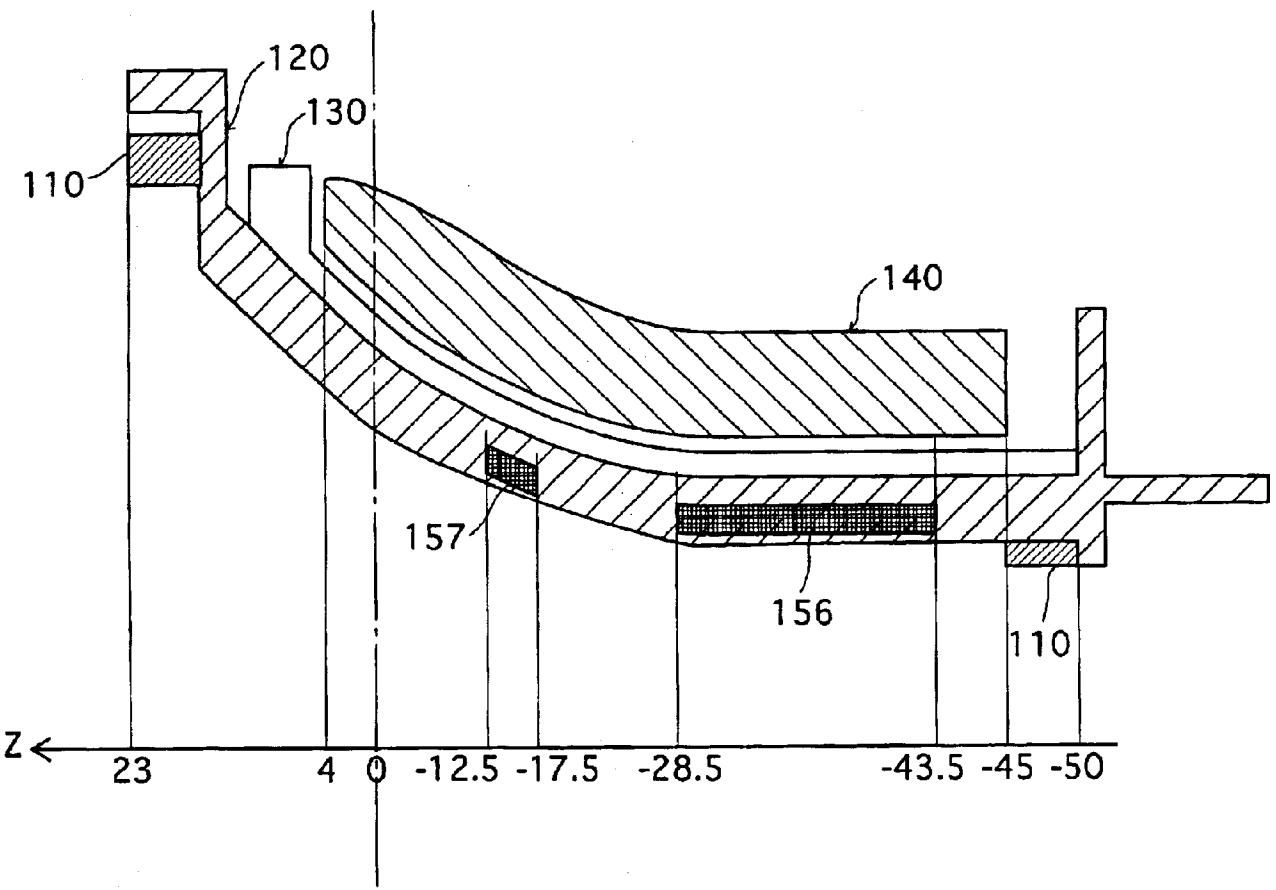
FIG. 21 is a partial sectional view showing a specific example of when a horizontal component is canceled out by providing a magnetizable member in a vertical deflection magnetic field.

FIG. 21 illustrates an example where the magnetizable member is used. As illustrated, a magnet 156 as the upper quadrupole magnetic field generation means is located from Z=−43.5 to −28.5 mm. The magnet 156 has a horizontal width of 15 mm, and a thickness of 1.5 mm in the direction of the Y axis. The magnetizable member 157 made of a permalloy is located from Z=−17.5 to −12.5 mm. The magnetizable member 157 has a horizontal width of 20 mm, and a thickness of 1.5 mm in the direction of the Y axis. The magnet 156 and the magnetizable member 157 are insulated from the horizontal deflection coil 110 by the insulating frame 120, as in the above embodiments.

In this example, the size and the like of the magnetizable member 157 are adjusted based on the magnetic flux density of the deflection magnetic field measured using a gauss meter, so that the magnetic flux density distribution when the magnetizable member 157 is provided is substantially the same as when the auxiliary magnetic field is used. The same effects as the above embodiments were confirmed by this construction.

Though the vertical deflection magnetic field is substantially uniform in FIG. 20, the vertical deflection magnetic field is not limited to a substantially uniform magnetic field. Even when the vertical deflection magnetic field is a barrel magnetic field, the effects of the present invention can be achieved by adjusting the size and the like of the magnetizable member.

Also, if the provision of the above magnetizable member 157 affects the horizontal deflection magnetic field, a method for adjusting the horizontal deflection magnetic field or the like may be employed to address the problem.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core;

a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects, the quadrupole magnetic field generation unit includes a core piece and a first wire wound around the core piece; and an auxiliary magnetic field generation unit which generates an auxiliary magnetic field for canceling out at least a part of the horizontal component of the quadrupole magnetic field, according to vertical deflection of the plurality of electron beams by the vertical deflection magnetic field, the auxiliary magnetic field generation unit includes a second wire wound around the core piece, the core piece, the first wire, and the second wire from a magnetic coil, and a magnetic flux generated by supplying a current to the second wire has an opposite direction to a direction of a magnetic flux generated by supplying a current to the first wire, wherein the quadruple magnetic field generation unit generates a magnetic flux that forms the quadrupole magnetic field, and when the plurality of electron beams are vertically deflected, the auxiliary magnetic field generation unit generates a magnetic flux which cancels out a part of the magnetic flux that is generated by the quadrupole magnetic field generation unit on one of upper and lower sides of a horizontal center line of the quadrupole magnetic field to which the plurality of electron beams are vertically deflected.

2. The color picture tube device of claim 1, wherein the current supplied to the second wire is synchronous with a vertical deflection current.

3. The color picture tube device of claim 1, wherein two magnet coils are provided above and below an area where the plurality of electron beams pass.

4. The color picture tube device of claim 3, wherein two core pieces included in the two magnet coils are each shaped along an outline of a glass bulb included in the color picture tube device.

5. The color picture tube device of claim 1, further comprising:

a positioning unit which adjusts a position of the core piece.

6. The color picture tube device of claim 1, wherein the end of the deflection region facing the electron gun positionally corresponds to an end of the core facing the electron gun.

7. The color picture tube device of claim 1, wherein the quadrupole magnetic field generation unit is made up of a plurality of separate units for generating the quadrupole magnetic field in a plurality of positions in a tube axial direction of the color picture tube device.

8. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core; and a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects, wherein the quadrupole magnetic field generation unit weakens the horizontal component of the quadrupole magnetic field, according to vertical deflection of the plurality of electron beams by the vertical deflection magnetic field.

9. The color picture tube device of claim 8, wherein the quadrupole magnetic field generation unit generates a magnetic flux that forms the quadrupole magnetic field, and when the plurality of electron beams are vertically deflected, the quadrupole magnetic field generation unit weakens a part of the magnetic flux that is generated on one of upper and lower sides of a horizontal center line of the quadrupole magnetic field to which the plurality of electron beams are vertically deflected.

10. The color picture tube device of claim 8, wherein the quadrupole magnetic field generation unit includes a core piece and a wire wound around the core piece.

11. The color picture tube device of claim 10, wherein a current synchronous with a vertical deflection current is supplied to the wire.

12. The color picture tube device of claim 10, further comprising:

a positioning unit which adjusts a position of the core piece.

13. The color picture tube device of claim 8, wherein the end of the deflection region facing the electron gun positionally corresponds to an end of the core facing the electron gun.

14. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core; and a magnetic field generation unit which generates, between the phosphor screen and an end of a deflection region facing the electron gun, a magnetic field having a vertical component and a horizontal component, the vertical component causing the plurality of electron beams to move toward or away from each other in a horizontal direction, the deflection region being where the horizontal and vertical deflection magnetic fields have deflection effects, wherein a magnetic field which is obtained by superposing the magnetic field generated by the magnetic field generation unit on the horizontal deflection magnetic field has a magnetic flux density distribution that is, as seen from above a tube axis of the color picture tube device, asymmetrical in the horizontal direction.

15. The color picture tube device of claim 14, wherein the end of the deflection region facing the electron gun positionally corresponds to an end of the core facing the electron gun.

16. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core;

a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects; and a magnetizable member which changes the vertical deflection magnetic field to a compound magnetic field, the compound magnetic field being made up of (a) the vertical deflection magnetic field and (b) a virtual auxiliary magnetic field for canceling out at least a part of the horizontal component of the quadrupole magnetic field in synchronization with vertical deflection of the plurality of electron beams by the vertical deflection magnetic field.

17. The color picture tube device of claim 16, wherein the magnetizable member is formed from a permalloy.

18. The color picture tube device of claim 16, wherein the quadrupole magnetic field generation unit includes two magnetic members, and generates the quadrupole magnetic field by opposing a north pole of each magnetic member to a south pole of the other magnetic member, each magnetic member being a magnet, a magnet coil, or a combination of a magnet and a magnet coil.

19. The color picture tube device of claim 18, wherein the quadrupole magnetic field is generated around a deflection center of the horizontal deflection magnetic field.

20. The color picture tube device of claim 18, wherein the magnetizable member is positioned closer to the phosphor screen than the two magnetic members in a tube axial direction of the color picture tube device.

21. The color picture tube device of claim 18, wherein the quadrupole magnetic field is closer to the electron gun than is a deflection center of the horizontal deflection magnetic field.

22. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core;

a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects; and an auxiliary magnetic field generation unit which generates an auxiliary magnetic field for canceling out at least a part of the horizontal component of the quadrupole magnetic field, according to vertical deflection of the plurality of electron beams by the vertical deflection magnetic field, wherein the quadrupole magnetic field generation unit includes a magnet, and the auxiliary magnetic field generation unit includes a wire wound around the magnet.

23. The color picture tube device of claim 22, wherein a current synchronous with a vertical deflection current is supplied to the wire.

24. A color picture tube device that deflects a plurality of electron beams and produces a color image on a phosphor screen, comprising:

an electron gun which has a plurality of in-line cathodes and emits the plurality of electron beams;

a deflection yoke which includes a horizontal deflection coil generating a horizontal deflection magnetic field, a vertical deflection coil generating a vertical deflection magnetic field, and a core;

a quadrupole magnetic field generation unit which generates, between the phosphor screen and an end of a deflection region facing the electron gun, a quadrupole magnetic field having a vertical component and a horizontal component, the vertical component causing the plurality of electron beams to move toward or away from each other in a horizontal direction, the deflection region being where the horizontal and vertical deflection magnetic fields have deflection effects; and an auxiliary magnetic field generation unit which generates an auxiliary magnetic field for canceling out at least a part of the horizontal component of the quadrupole magnetic field, according to vertical deflection of the plurality of electron beams by the vertical deflection magnetic field, wherein the quadrupole magnetic field generation unit includes a core piece which has a magnetic portion and a magnetization portion, and the auxiliary magnetic field generation unit includes a wire which is wound around at least a part of the magnetizable portion of the core piece.

25. The color picture tube device of claim 24, wherein a current synchronous with a vertical deflection current is supplied to the wire, and a magnetic flux generated by supplying the current to the wire has an opposite direction to a direction of a magnetic flux generated from the magnet portion.

* * * * *